US007033002B2

(12) United States Patent
Tanaka

(10) Patent No.: US 7,033,002 B2
(45) Date of Patent: Apr. 25, 2006

(54) ELECTROSTATIC ACTUATOR AND LIQUID DROPLET EJECTING HEAD HAVING STABLE OPERATION CHARACTERISTICS AGAINST ENVIRONMENTAL CHANGES

(75) Inventor: Shinji Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/507,346

(22) PCT Filed: May 15, 2003

(86) PCT No.: PCT/JP03/06082

§ 371 (c)(1),
(2), (4) Date: Sep. 13, 2004

(87) PCT Pub. No.: WO03/097364

PCT Pub. Date: Nov. 27, 2003

(65) Prior Publication Data

US 2005/0104941 A1 May 19, 2005

(30) Foreign Application Priority Data

May 20, 2002 (JP) ..... 2002-145300
Sep. 5, 2002 (JP) ..... 2002-259573

(51) Int. Cl.
*B41J 2/045* (2006.01)

(52) U.S. Cl. ..... 347/70

(58) Field of Classification Search ..... 347/68, 347/70
See application file for complete search history.

(56) References Cited

FOREIGN PATENT DOCUMENTS

| | | |
|---|---|---|
| JP | 2-289351 | 11/1990 |
| JP | 5-50601 | 3/1993 |
| JP | 6-71882 | 3/1994 |
| JP | 10-193600 | 7/1998 |
| JP | 11-286109 | 10/1999 |
| JP | 2000-272120 | 10/2000 |
| JP | 2000-299991 | 10/2000 |
| JP | 2001-258274 | 9/2001 |
| JP | 2001-277506 | 10/2001 |
| JP | 2001-300421 | 10/2001 |
| JP | 2001-322269 | 11/2001 |
| JP | 2002-59548 | 2/2002 |
| JP | 2002-67303 | 3/2002 |
| JP | 2002240282 A * | 8/2002 |

* cited by examiner

*Primary Examiner*—K. Feggins
(74) *Attorney, Agent, or Firm*—Cooper & Dunham LLP

(57) ABSTRACT

A liquid droplet ejecting head includes: one or more nozzle holes ejecting liquid droplets; one or more pressure liquid chambers communicating with the nozzle holes and containing liquid to be ejected; a common liquid chamber communicating with the pressure liquid chambers; one or more diaphragms each forming a wall face of the corresponding pressure liquid chamber; one or more vibration chambers containing air gaps provided in contact with the diaphragms on the opposite side from the pressure liquid chambers; and one or more electrodes provided to oppose the diaphragms through the air gaps. The liquid droplet ejecting head further includes: a deformable plate whose deformation is greater than the total deformation of the diaphragms, the deformable plate forming a wall face of the common liquid chamber, and a pressure correcting chamber provided across the deformable plate from the common liquid chamber so as to communicate with the vibration chambers.

27 Claims, 14 Drawing Sheets

ELECTROSTATIC ACTUATOR AND LIQUID DROPLET EJECTING HEAD HAVING STABLE OPERATION CHARACTERISTICS AGAINST ENVIRONMENTAL CHANGES

TECHNICAL FIELD

The present invention generally relates to ink-jet recording, and more particularly to an electrostatic actuator, a liquid droplet ejecting head, an ink (liquid supplying) cartridge, an ink-jet recording apparatus, and a micropump.

BACKGROUND ART

Of the ink-jet recording apparatuses that perform recording on a recording medium by ejecting ink droplets directly onto the recording medium from nozzles, those of an on-demand type that eject ink only when necessary do not require a mechanism for collecting ink. Therefore, the on-demand-type ink-jet recording apparatuses can be reduced in cost and size, and have features that can support color recording.

The ink-jet recording apparatuses are employed as image-recording apparatuses or image-forming apparatuses such as printers, facsimile machines, copiers, and plotters. An ink-jet head, which is a liquid droplet ejecting head employed in the ink-jet recording apparatuses, includes: one or a plurality of nozzles for ejecting ink droplets; one or a plurality of pressure liquid chambers (also called ejection chambers, pressure chambers, liquid chambers, and ink channels) communicating with the nozzles; and means (actuator means) for generating pressure for pressurizing ink in the pressure liquid chambers. The ink in the pressure liquid chambers is pressurized by the actuator means so that ink droplets are ejected from the nozzles.

The liquid droplet ejecting heads include those ejecting a liquid resist as liquid droplets and those ejecting a DNA sample as liquid droplets. The following description, however, focuses on the ink-jet head. An actuator forming the actuator part of the liquid droplet ejecting head is also applicable to micro devices such as a micropump, an optical device such as a micro-optical modulator, a microswitch (micro-relay), the actuator of a multi-optical lens (an optical switch), a micro-flowmeter, and a pressure sensor.

A piezoelectric ink-jet head or a bubble-type ink-jet head is popularly used as such an ink-jet head, while an electrostatic ink-jet head using electrostatic force as means for generating pressure is also known.

The piezoelectric ink-jet head, which employs electromechanical transduction, generates pressure waves in the ink chambers by the electrostatic displacement of the piezoelectric elements, thereby ejecting ink from the ink nozzles. The bubble-type ink-jet head, which employs electro-thermal transduction, generates bubbles in the ink chambers by a heater that is heated to high temperature in a short time so as to eject ink by the volume expansion of the bubbles.

Further, the electrostatic ink-jet head includes multiple actuators provided in parallel, the multiple actuators each including a pressure liquid chamber communicating with an ink nozzle hole, a diaphragm forming a wall of the pressure liquid chamber, and an electrode provided opposite the diaphragm with a predetermined minute air gap formed therebetween. In each actuator, a voltage is applied to the electrode so that the diaphragm is deformed. Thereby, pressure is generated in the pressure liquid chamber, so that the ink liquid in the pressure liquid chamber is ejected from the ink nozzle hole as a liquid droplet. In other words, the electrostatic ink-jet head deforms the diaphragm of each actuator using an electrostatic attraction force, and ejects the ink in the pressure liquid chamber from the nozzle hole by mechanical force at the time of the deformation or by mechanical repulsion generated in the diaphragm when the electrostatic attraction force disappears.

Recently, the bubble-type and electrostatic ink-jet heads, which are lead-free, have attracted attention in terms of environmental protection. Particularly, the electrostatic ink-jet head, which consumes less power in addition to being lead-free so as to have less effect on the environment, is available in a wide variety.

Further, the electrostatic ink-jet head is producible by wafer processing. Therefore, it is easy to produce a high-density ink-jet head, and it is possible to produce a large number of devices of stable characteristics. Further, the electrostatic ink-jet head, which is based on a planar structure, is characterized by easiness in reducing its size (Japanese Laid-Open Patent Applications No. 2-289351, No. 5-050601, and No. 6-071882).

Next, FIG. 1 is an exploded perspective view of a conventional electrostatic liquid droplet ejecting head 100, and FIG. 2 is a longitudinal sectional view of an actuator part of the liquid droplet ejecting head 100 in an assembled state. The liquid droplet ejecting head 100, which is, for instance, an ink-jet head employed in an ink-jet recording apparatus, includes a layer structure formed by superimposing and joining a channel substrate 101 that is a first substrate, an electrode substrate 102 that is a second substrate, and a nozzle plate 103 that is a third substrate so that the electrode substrate 102 is joined to the lower side of the channel substrate 101 and the nozzle plate 103 is joined to the upper side of the channel substrate 101.

Further, the liquid droplet ejecting head 100 includes: a plurality of nozzle holes 131 formed at appropriate positions in the nozzle plate 103 as through holes; pressure liquid chambers 111 that are ink channels communicating with the nozzle holes 131; diaphragms 113 forming wall faces of the pressure liquid chambers 111; a common liquid chamber 112 communicating with the pressure liquid chambers 111 via fluid resistance parts 115 connecting the common liquid chamber 112 and the pressure liquid chambers 111; and individual electrodes 122 provided below and opposite the diaphragms 113 with spaces (vibration chambers) 121 for deflecting the diaphragms 113 by electrostatic forces being formed therebetween. The fluid resistance parts 115 may be provided as recesses on the lower surface of the nozzle plate 103. In each actuator, a voltage applied to the electrode 122 causes a potential difference-between the electrode 122 and the diaphragm 113 so that the diaphragm 113 deflects (vibrates). Ink is ejected from the nozzle hole 131 by a pressure wave generated when the diaphragm 113 returns toward the pressure liquid chamber 111 after deflecting toward the vibration chamber 121.

The pressure liquid chambers 111 each have an elongated shape, and are provided parallel to one another, separated by partition walls 111*a*. The nozzle holes 131 are formed as individual through holes in the nozzle plate 103 in the parts corresponding to the pressure liquid chambers 111. When the nozzle plate 103 is joined to the upper side of the channel substrate 101, the pressure liquid chambers 111 are separated by the partition walls 111*a*.

The electrodes 122, which are provided on the electrode substrate 102, are formed at the bottom of the vibration chambers 121 formed so as to correspond to the pressure liquid chambers 111 formed on the channel substrate 101. The vibration chambers 121 are partitioned by partition, walls 121*a*.

The common liquid chamber 112 is provided so as to extend over the end part of each pressure liquid chamber 111. Ink is supplied from an ink tank (not shown in the drawings) to the common liquid chamber 112 via an ink supply hole (a liquid droplet supply hole) (not shown in the drawings) communicating with the lower part of the common liquid chamber 112 and other parts. The ink is further supplied from the common liquid chamber 112 via the liquid resistance parts 132 to the pressure liquid chambers 111.

The market demand for energy saving is growing for office automation equipment including ink-jet printers as well as for other electronic equipment. The electrostatic liquid droplet ejecting head, which is characterized by low power consumption compared with other types of liquid droplet ejecting heads, requires a further reduction in its driving voltage in order to achieve a further reduction in power consumption. In order to meet such a demand, the vertical dimension of the vibration chambers 121 (or the distance between the electrodes 122 and the diaphragms 113) (hereinafter this distance may be referred to as an air gap) and the thickness of the diaphragms 113 need to be reduced. This configuration can indeed lower the driving voltage. According to this configuration, however, the vibration chambers 121 have a reduced vertical dimension and the diaphragms 113 have reduced rigidity. Therefore, if moisture exists in the vibration chambers 121, the diaphragms 113 adhere to and remain in contact with the electrodes 122 through liquid bridging or hydrogen bonding, thereby preventing the actuators from functioning. Accordingly, no fluid (liquid) should be allowed into the vibration chambers 121 from the outside. For this purpose, it is desirable that the vibration chambers 121 be completely isolated from the external environment. At least, liquid such as water should be prevented from entering the vibration chambers 121.

Therefore, the openings of the vibration chambers 121 may be sealed by a sealing material so as to hermetically seal the vibration chambers 121. There arises another problem, however, in the case of employing the configuration that does not allow gas outside the liquid droplet ejecting head to enter and exit from the vibration chambers 121 and a space communicating therewith (hereinafter referred to collectively as an actuator chamber). That is, the gas inside the actuator chamber and the gas outside the head cannot freely communicate with each other, so that a change in pressure or temperature in the external environment causes a difference in pressure between the actuator chamber and the external environment, thereby changing the equilibrium positions of the diaphragms 113 in accordance with the magnitude of the pressure difference. For instance, if the pressure inside the actuator chamber is lower than the pressure outside the head, the equilibrium position of each diaphragm 113 approaches the electrode side. If the pressure inside the actuator chamber is higher than the pressure outside the head, the equilibrium position of each diaphragm 113 moves away from the electrode side. As a result, the amount and the velocity of liquid droplets ejected from the liquid droplet ejecting head vary in accordance with the pressure difference between the actuator chamber and the external environment, thereby preventing the head from maintaining stable ejection characteristics. This results in the degradation of image quality. Accordingly, it is necessary to provide some kind of correction means with respect to pressure and temperature.

The following are conventional measures to eliminate the above-described disadvantage.

According to "a method and device for driving and controlling an ink-jet head" disclosed in Japanese Laid-Open Patent Application No. 11-286109 (hereinafter referred to as first prior art), an external pressure is read by a pressure sensor employed as pressure detecting means or is manually input, and the waveform of a driving voltage is changed in accordance with the read or input external pressure.

According to "an electrostatic actuator and a liquid jetting apparatus using the same" disclosed in Japanese Laid-Open Patent Application No. 2001-300421 (hereinafter referred to as second prior art), a thin plate communicating with the atmosphere called a displaceable (deformable) plate is provided to a substrate called a cavity plate in which substrate diaphragms are formed, and a pressure compensation chamber (pressure correcting chamber) is formed across the displaceable plate from the atmosphere (or an atmospheric pressure chamber open to the atmosphere) so as to communicate with vibration chambers so that the pressure in the vibration chambers is compensated by the deflection of the displaceable plate. The displaceable plate forming a wall face of the pressure compensation chamber has a rigidity lower than that of each diaphragm so as to be displaced in accordance with the external atmospheric pressure.

According to the first prior art, however, storage means for storing the relationship between pressure and driving voltage waveform for compensating for a variation in the ink-jet characteristics and control means are further required in addition to the pressure detecting means, thus inevitably increasing the cost of products.

According to the second prior art, even if the actuator chamber is hermetically isolated from the atmosphere, the deformation of the diaphragms can be controlled not by a change in the equilibrium position of each diaphragm but by a great change in the equilibrium position of the displaceable plate when a difference is generated between the pressures inside and outside the actuator chamber.

The ink-jet head of the second prior art, although incurring a slight increase in its size, reduces a variation in the equilibrium position of each diaphragm only by its configuration. Therefore, unlike the method of providing a pressure sensor, for instance, which method cannot be expected in principle to produce a desired effect, the ink-jet head of the second-prior art is expected to produce a sufficient effect.

This configuration, however, also includes another problem due to the fact that the rigidity of the displaceable plate is sufficiently lower than that of each diaphragm. That is, if the distance between the displaceable plate and its opposing surface is small, the displaceable plate easily comes into contact with the opposing surface due to the generation of the difference between the pressures inside and outside the head. At this point, once the displaceable plate comes into contact with the opposing surface, the displaceable plate, whose rigidity is extremely low, sticks thereto due to the van der Waals force exerted on the displaceable plate and its opposing surface so as to lose its function. Further, if absorption water or a residual electric charge exists between the displaceable plate and its opposing surface, the displaceable plate sticks to its opposing surface more easily.

On the other hand, if the distance between the displaceable plate and its opposing surface is large, the displaceable plate is prevented from coming in contact with its opposing surface. Therefore, the displaceable plate is prevented from sticking to its opposing surface, but the volume of the pressure compensation chamber is increased. That is, the volume of the actuator chamber is significantly increased, so that the difference between the pressures inside and outside the actuator chamber exerts a more significant effect. As a result, a larger area is required as a space for the pressure compensation chamber, thus increasing the size and cost of the head and leading to an increase in the size of a printer using the head. This is not preferable in terms of space saving.

Thus, in the conventional electrostatic actuator and the ink-jet head using the same of the second prior art, the sticking of the displaceable plate cannot be prevented by reducing the distance between the displaceable plate and its opposing surface without incurring an unnecessary increase in the size of the head. That is, the stable ejection or operation characteristics cannot be obtained.

As described above, the vertical dimension of a vibration chamber formed between a diaphragm forming a wall of a pressure liquid chamber and the corresponding electrode of an electrostatic ink-jet head is not more than a few microns. If the vibration chamber is left open to the atmospheric environment, dust may enter the vibration chamber so as to prevent the diaphragm from deforming. Further, if moisture adheres to the surface of the diaphragm, the diaphragm may adhere to the electrode through liquid bridging, thus causing ejection failure. Furthermore, when the diaphragm is driven continuously, the vibration chamber may gradually lose the gas inside so as to enter a depressurized state. Then, even if no voltage is applied to the electrode, the diaphragm may deflect toward the electrode side never to return to its equilibrium position, thus resulting in an insufficient amount of or insufficient pressure for ink ejection. Normally, therefore, a part open to the atmosphere which part communicates with the vibration chamber is sealed by resin so that the vibration chamber is hermetically sealed.

However, in the case of hermetically sealing the vibration chamber interposed between the diaphragm and the electrode in an environment, for instance, where the atmospheric pressure is extremely different from its normal state as in highlands where the atmospheric pressure is lower than its normal value, the diaphragm is kept deflected toward the pressure liquid chamber side by the pressure difference between the pressure inside the vibration chamber and the low external pressure, thus resulting in ejection failure. If the external pressure is higher than the pressure inside the vibration chamber, the diaphragm is kept deflected in the opposite direction.

Therefore, according to the technologies disclosed in Japanese Laid-Open Patent Applications No. 11-286109 and No. 2000-272120, the difference between the pressure inside a vibration chamber and the external atmospheric pressure is measured by the pressure detecting means so as to correct the waveform of the driving voltage, and a vibration plate of a large area for pressure control is additionally provided so as to change the volume of a hermetically sealed part. Thereby, the difference between the pressure inside the vibration chamber and the external atmospheric pressure is controlled. However, the addition of the pressure detecting means or the large-area pressure control means adds to the cost of the head and makes chip downsizing and integration difficult.

DISCLOSURE OF THE INVENTION

Accordingly, it is a general object of the present invention to provide an electrostatic actuator and a liquid droplet ejecting head in which the above-described disadvantages are eliminated.

A more specific object of the present invention is to provide a downsized electrostatic actuator having stable operation characteristics against environmental changes and a liquid droplet ejecting head using the electrostatic actuator to realize stable ejection characteristics against environmental changes without an increase in size and cost.

Another more specific object of the present invention is to provide an ink cartridge (liquid supply cartridge), an ink-jet recording apparatus, and a micropump using the liquid droplet ejecting head.

The above objects of the present invention are achieved by a liquid droplet ejecting head ejecting liquid droplets by pressure waves caused by electrostatic forces, the liquid droplet ejecting head including: one or more nozzle holes ejecting the liquid droplets; one or more pressure liquid chambers communicating with the nozzle holes and containing liquid to be ejected; a common liquid chamber communicating with the pressure liquid chambers; one or more diaphragms each forming a wall face of the corresponding pressure liquid chamber; one or more vibration chambers containing air gaps provided in contact with the diaphragms on an opposite side from the pressure liquid chambers; and one or more electrodes provided to oppose the diaphragms through the air gaps, the liquid droplets being ejected from the nozzle holes by increasing pressure inside the pressure liquid chambers by deflecting the diaphragms by the electrostatic forces generated by voltages applied to the electrodes, the liquid droplet ejecting head including: a deformable plate whose deformation is greater than a total deformation of the diaphragms, the deformable plate forming a wall face of the common liquid chamber; and a pressure correcting chamber provided across the deformable plate from the common liquid chamber so as to communicate with the vibration chambers.

According to the present invention, a reliable liquid droplet ejecting head employable under a wide range of environmental pressures can be realized at reduced cost by forming a pressure correcting part by making a simple modification of part of the existing element (common liquid chamber) so that the part is easily deformable. Therefore, no special element such as a pressure detecting part is additionally required, thereby preventing an increase in the number of production processes, cost, and size of the liquid droplet ejecting head. Further, the configuration and the entire production process of the liquid droplet ejecting head are prevented from becoming complicated.

The above objects of the present invention are also achieved by an ink cartridge including: a liquid droplet ejecting head ejecting ink droplets by pressure waves caused by electrostatic forces; and an ink tank supplying ink to the liquid droplet head, the ink tank being integrated with the liquid droplet ejecting head, wherein the liquid droplet ejecting head includes: one or more nozzle holes ejecting the ink droplets; one or more pressure liquid chambers communicating with the nozzle holes and containing the ink to be ejected; a common liquid chamber communicating with the pressure liquid chambers; one or more diaphragms each forming a wall face of the corresponding pressure liquid chamber; one or more vibration chambers containing air gaps provided in contact with the diaphragms on an opposite side from the pressure liquid chambers; and one or more electrodes provided to oppose the diaphragms through the air gaps, the ink droplets being ejected from the nozzle holes by increasing pressure inside the pressure liquid chambers by deflecting the diaphragms by the electrostatic forces generated by voltages applied to the electrodes, the liquid droplet ejecting head including: a deformable plate whose deformation is greater than a total deformation of the diaphragms, the deformable plate forming a wall face of the common liquid chamber; and a pressure correcting chamber provided across the deformable plate from the common liquid chamber so as to communicate with the vibration chambers.

The above-described ink cartridge includes a liquid droplet ejecting head according to the present invention. Therefore, the ink cartridge is reliable and can be produced at reduced cost and with a reduced proportion of defectives.

The above objects of the present invention are also achieved by an ink-jet recording apparatus including: an ink-jet head ejecting ink droplets by pressure waves caused by electrostatic forces, the ink-jet head including: one or more nozzle holes ejecting the ink droplets; one or more pressure liquid chambers communicating with the nozzle holes and containing ink to be ejected; a common liquid chamber communicating with the pressure liquid chamber; one or more diaphragms each forming a wall face of the corresponding pressure liquid chambers; one or more vibration chambers containing air gaps provided in contact with the diaphragms on an opposite side from the pressure liquid chambers; and one or more electrodes provided to oppose the diaphragms through the air gaps, the ink droplets being ejected from the nozzle holes by increasing pressure inside the pressure liquid chambers by deflecting the diaphragms by the electrostatic forces generated by voltages applied to the electrodes, the ink-jet head including: a deformable plate whose deformation is greater than a total deformation of the diaphragms, the deformable plate forming a wall face of the common liquid chamber; and a pressure correcting chamber provided across the deformable plate from the common liquid chamber so as to communicate with the vibration chambers.

The above-described ink-jet recording apparatus includes a liquid droplet-ejecting head according to the present invention. Therefore, the ink-jet recording apparatus is reliable and can perform high-quality image recording.

The above objects of the present invention are also achieved by a micropump transporting liquid by deformation of one or more diaphragms, the micropump including: a channel in which the liquid is transported; the diaphragms forming a wall face of the channel, one or more vibration chambers containing air gaps provided in contact with the diaphragms on an opposite side from the channel; and a plurality of electrodes provided to each of the diaphragms, the liquid being transported by increasing pressure inside the channel by deflecting the diaphragms by electrostatic forces generated by voltages applied to the electrodes, the micropump including: a deformable plate whose deformation is greater than a total deformation of the diaphragms, the deformable plate forming the wall face of the channel; and a pressure correcting chamber provided across the deformable plate from the channel so as to communicate with the vibration chambers.

The above-described micropump deforms the diaphragms by electrostatic forces exerted between the electrodes. Therefore, the micropump is reduced in size and consumes less power.

The above objects of the present invention are also achieved by an electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a part that reduces an area of contact formed when the deformable part comes into contact with a second side of the pressure correcting chamber, the second side opposing the deformable part.

According to the above-described electrostatic actuator, the area of contact of the deformable part at the time of its contact with the second opposing side of the pressure correcting chamber is reduced. Therefore, the cohesive force exerted at the time of the contact is substantially controlled so that the deformable part is prevented from sticking to the second side of the pressure correcting chamber. Accordingly, the electrostatic actuator can be reduced in size and have stable operation characteristics.

The above objects of the present invention are also achieved by an electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a sticking preventing part formed on a second side of the pressure correcting chamber so as to prevent the deformable part from sticking to the second side when the deformable part comes into contact therewith, the second side opposing the deformable part.

According to the above described electrostatic actuator, the deformable part is prevented from sticking to the second side of the pressure correcting chamber at the time of its contact with the second side. Accordingly, the electrostatic actuator can be reduced in size and have stable operation characteristics.

The above objects of the present invention are also achieved by a liquid droplet ejecting head including: a nozzle ejecting a liquid droplet; a pressure liquid chamber containing liquid to be ejected, the pressure liquid chamber communicating with the nozzle; and an electrostatic actuator pressurizing the liquid in the pressure liquid chamber, the electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a part that reduces an area of contact formed when the deformable part comes into contact with a second side of the pressure correcting chamber, the second side opposing the deformable part.

The above objects of the present invention are also achieved by a liquid droplet ejecting head including: a nozzle ejecting a liquid droplet; a pressure liquid chamber containing liquid to be ejected, the pressure liquid chamber communicating with the nozzle; and an electrostatic actuator pressurizing the liquid in the pressure liquid-chamber, the electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including: a sticking preventing part formed on a second side of the pressure correcting chamber so as to prevent the deformable part from sticking to the second side when the deformable part comes into contact therewith, the second side opposing the deformable part.

The above-described liquid droplet ejecting heads include an electrostatic actuator according to the present invention. Therefore, the liquid droplet ejecting heads have stable liquid droplet ejecting characteristics so as to increase their reliability and improve image quality.

The above objects of the present invention are also achieved by an ink-jet recording apparatus including: an ink-jet head ejecting an ink droplet, the ink-jet head including: a nozzle ejecting the ink droplet; a pressure liquid chamber containing ink to be ejected, the pressure liquid chamber communicating with the nozzle; and an electrostatic actuator pressurizing the ink in the pressure liquid chamber, the electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a part that reduces an area of contact formed when the deformable part comes into contact with a second side of the pressure correcting chamber, the second side opposing the deformable part.

The above objects of the present invention are also achieved by an ink-jet recording apparatus including: an ink-jet head ejecting an ink droplet, the ink-jet head including: a nozzle ejecting the ink droplet; a pressure liquid chamber containing ink to be ejected, the pressure liquid chamber communicating with the nozzle; and an electrostatic actuator pressurizing the ink in the pressure liquid chamber, the electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a sticking preventing part formed on a second side of the pressure correcting chamber so as to prevent the deformable part from sticking to the second side when the deformable part comes into contact therewith, the second side opposing the deformable part.

The above-described ink-jet recording apparatuses include a liquid droplet ejecting head (ink-jet head) according to the present invention. Therefore, the ink-jet recording apparatuses can perform high-quality image recording.

The above objects of the present invention are also achieved by a liquid supply cartridge integrating a liquid droplet ejecting head and a liquid supply tank supplying liquid thereto, wherein the liquid droplet ejecting head includes: a nozzle ejecting a liquid droplet; a pressure liquid chamber containing the liquid to be ejected, the pressure liquid chamber communicating with the nozzle; and an electrostatic actuator pressurizing the liquid in the pressure liquid chamber, the electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a part that reduces an area of contact formed when the deformable part comes into contact with a second side of the pressure correcting chamber, the second side opposing the deformable part.

The above objects of the present invention are further achieved by a liquid supply cartridge integrating a liquid droplet ejecting head and a liquid supply tank supplying liquid thereto, wherein the liquid droplet ejecting head includes: a nozzle ejecting a liquid droplet; a pressure liquid chamber containing the liquid to be ejected, the pressure liquid chamber communicating with the nozzle; and an electrostatic actuator pressurizing the liquid in the pressure liquid chamber, the electrostatic actuator including: a vibration chamber having at least one side thereof formed by a diaphragm deformable by an electrostatic force; an electrode provided opposite the diaphragm; and a pressure correcting chamber communicating with the vibration chamber, the pressure correcting chamber having at least a first side thereof formed by a deformable part that is displaceable in accordance with an external pressure, the electrostatic actuator including a sticking preventing part formed on a second side of the pressure correcting chamber so as to prevent the deformable part from sticking to the second side when the deformable part comes into contact therewith, the second side opposing the deformable part.

The above-described ink cartridges include a liquid droplet ejecting head according to the present invention.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description will now be given, with reference to the accompanying drawings, of embodiments of the present invention.

First Embodiment

In the following description, an electrostatic liquid droplet ejecting head employs individual electrodes and diaphragms opposing each other with air gaps formed therebetween. A potential difference is provided between the diaphragms serving as a common electrode and each individual electrode so that-the diaphragms deflect to generate pressure.

In the case of giving a more detailed description using mathematical expressions, a deformable plate whose deformation is greater than the total deformation of the diaphragms is considered as a rectangular thin plate. The nature of the deformable plate remains the same irrespective of its shape as long as the deformable plate has a greater deformation.

Figure 1:
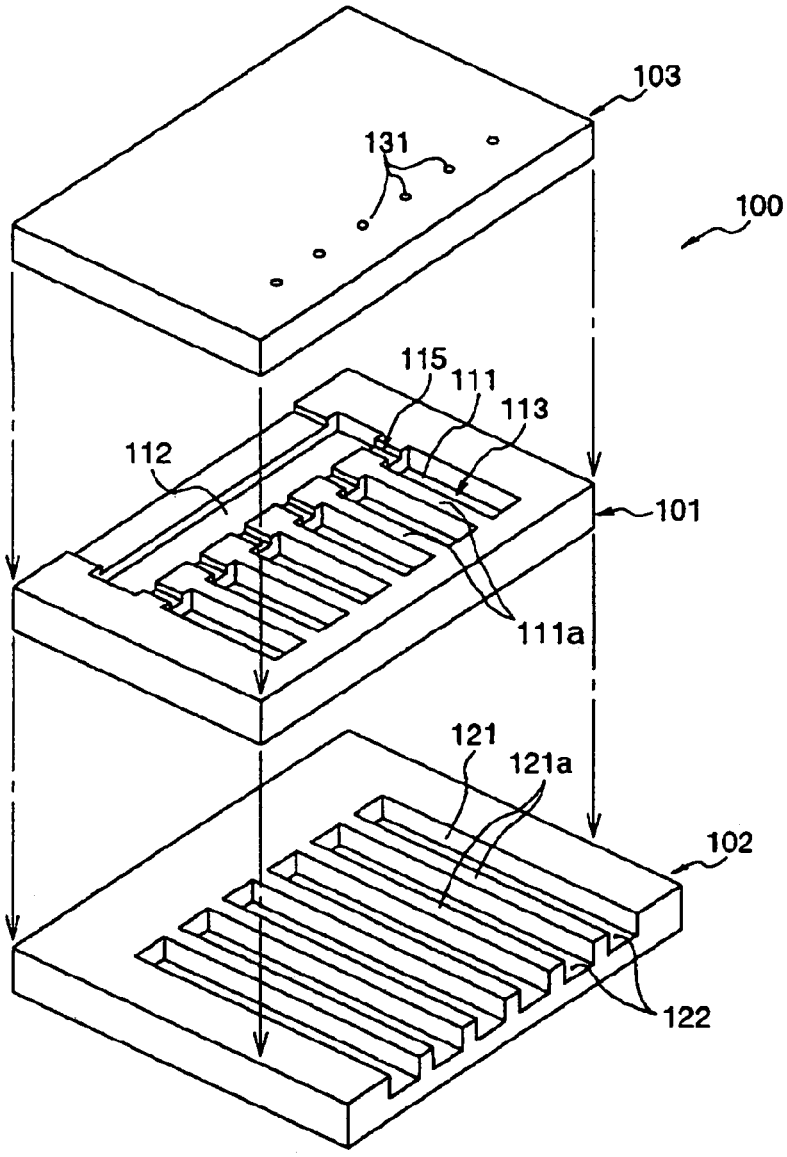
FIG. 1 is an exploded perspective view of a conventional electrostatic liquid droplet ejecting head.
Figure 2:
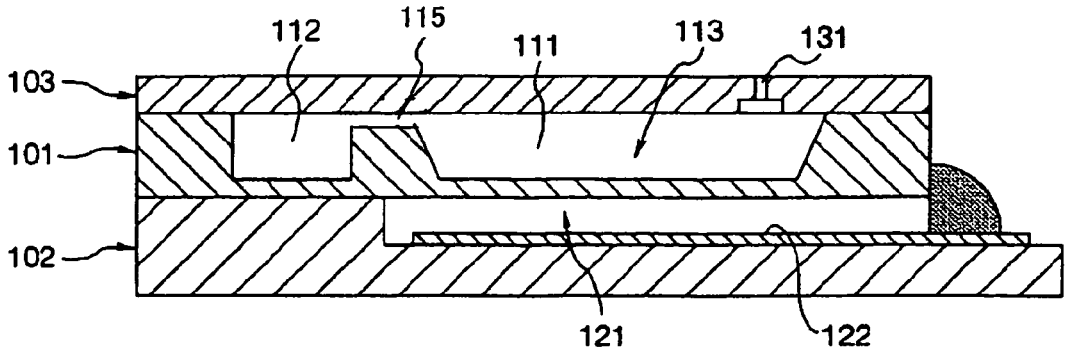
FIG. 2 is a longitudinal sectional view of an actuator part of the liquid droplet ejecting head of FIG. 1.
Figure 3:
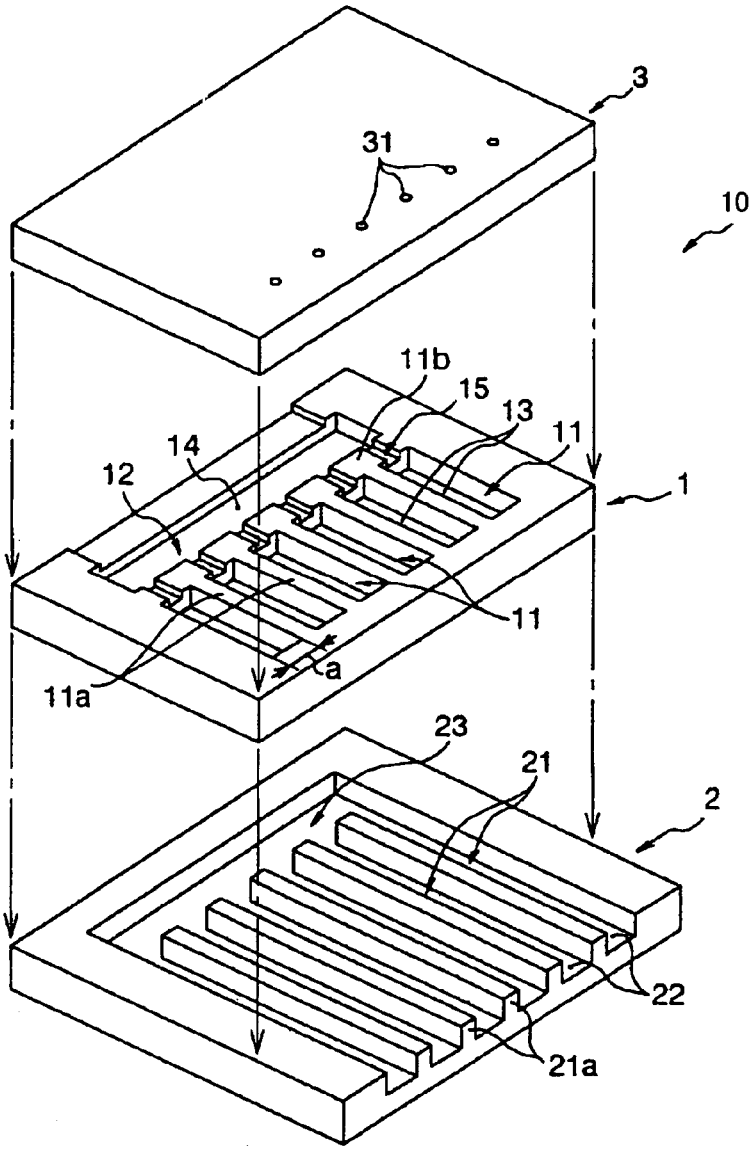
FIG. 3 is an exploded perspective view of an electrostatic liquid droplet ejecting head according to a first embodiment of the present invention.
Figure 4:
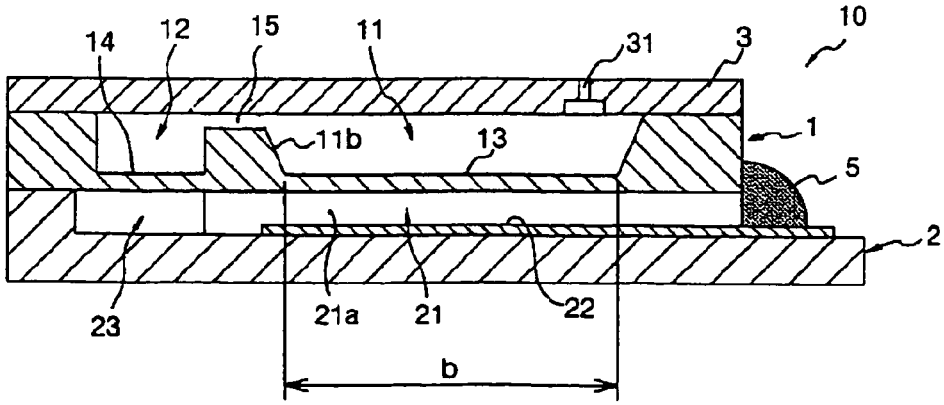
FIG. 4 is a longitudinal sectional view of an actuator part of the liquid droplet ejecting head of FIG. 3 in an assembled state according to the first embodiment of the present invention.

FIG. 3 is an exploded perspective view of an electrostatic liquid droplet ejecting head 10 according to a first embodiment of the present invention. FIG. 4 is a longitudinal sectional view of an actuator part of the liquid droplet ejecting head 10 in an assembled state.

The liquid droplet ejecting head 10 of this embodiment, which is, for instance, an ink-jet head employed in an ink-jet recording apparatus, includes a layer structure formed by superimposing and joining a channel substrate 1 that is a first substrate, an electrode substrate 2 that is a second substrate, and a nozzle plate 3 that is a third substrate so that the electrode substrate 2 is joined to the lower side of the channel substrate 1 and the nozzle plate 3 is joined to the upper side of the channel substrate 1. A sealing material 5 is provided to the liquid droplet ejecting head 10 as shown in FIG. 4.

The liquid droplet ejecting head 10 includes: a plurality of nozzle holes 31 formed in the nozzle plate 3 at appropriate positions as through holes; pressure liquid chambers 11 that are ink channels communicating with the nozzle holes 31; diaphragms 13 each forming a wall face of the corresponding pressure liquid chamber 11; a common liquid chamber 12 communicating with the pressure liquid chambers 11 through fluid resistance parts 15 that are channels connecting the common liquid chamber 12 and the pressure liquid chambers 11; and individual electrodes 22 provided below and opposite the diaphragms 13 with air gaps (vibration chambers) 21 for deflecting the diaphragms 13 by electrostatic forces being formed therebetween. The fluid resistance parts 15 may be provided as recesses on the lower surface of the nozzle plate 3. That is, the liquid droplet ejecting head 10 includes a plurality of actuators formed parallel to one another, the actuators each including the pressure liquid chamber 11 communicating with the corresponding nozzle hole 31, the diaphragm 13 forming a wall face (bottom face) of the pressure liquid chamber 11, and the electrode 22 opposing the diaphragm 13 with the vibration chamber 21 being formed therebetween. In each actuator, a potential difference is provided between the electrode 22 and the diaphragm 13 by a voltage applied to the electrode 22 so that the diaphragm 13 deflects (or vibrates). Ink is ejected from the nozzle hole 31 by a pressure wave generated when the diaphragm 13 returns toward the pressure liquid chamber 11 after deflecting toward the vibration chamber 21.

The pressure liquid chambers 11 each having an elongated shape are provided parallel to one another, separated by partition walls 11*a*. The nozzle holes 31 are formed as individual through holes in the nozzle plate 3 in the parts corresponding to the pressure liquid chambers 11. When the nozzle plate 3 is joined to the upper side of the channel substrate 1, the pressure liquid chambers 11 are separated by the partition walls 11*a*.

The electrodes 22, which are provided on the electrode substrate 2, are formed at the bottom of the vibration chambers 21 formed so as to correspond to the pressure liquid chambers 11 formed on the channel substrate 1. The vibration chambers 21 are partitioned by partition walls 21*a*.

The common liquid chamber 12 is provided so as to extend orthogonally across the end parts of the pressure liquid chambers 11. Ink is supplied from an ink tank (not shown in the drawings) to the common liquid chamber 12 via an ink supply hole (a liquid droplet supply hole) (not shown in the drawings) communicating with the lower part of the common liquid chamber 12 and other parts. The ink is further supplied from the common liquid chamber 12 via the liquid resistance parts 32 to the pressure liquid chambers 11.

The configuration of the common liquid chamber 12 may vary depending on a head configuration. According to this embodiment, the common liquid chamber 12 characteristically employs a deformable plate 14 (forming a pressure correcting part) that deforms more easily than the diaphragms 13 as a wall face (bottom face) of the common liquid chamber 12. That is, the deformable plate 14, which is provided on substantially the same plane as the diaphragms 13 so as to be connected thereto through partition walls 11*b*, is set so as to have a deformation (deflection or displacement) greater than the total deformation of the diaphragms 13. In other words, the value of δ of the deformable plate 14 is set to be greater than that of the diaphragms 13 in the following equation (1) concerning the deformation (deflection or displacement) δ of the deformable plate 14, letting a pressure P remain the same.

$$\delta = \frac{1 - v^2}{32E}\frac{a^4}{t^3}P \tag{1}$$

where v is the Poisson's ratio of the material of a plate, E is a Young's modulus, a is the width of the plate, and t is the thickness of the plate.

It is apparent that letting the material and configuration parameters other than the plate thickness t be constant, the deformation of the deformable plate 14 can be varied by changing the plate thickness t.

Further, the liquid droplet ejecting head 10 includes a pressure correcting chamber 23 (forming the pressure correcting part) that is a space provided at a side (bottom) of the deformable plate 14 opposite from the common liquid chamber 12 so as to communicate with the vibration chambers 21. A space inside the head 10 which space is formed of the pressure correcting chamber 23, the vibration chambers 21, and a space communicating therewith is completely isolated from the atmosphere. This space is referred to as an actuator chamber. According to this configuration, the deformable plate 14 having a lower rigidity than each diaphragm 13 communicates with the vibration chambers 21. Therefore, when a pressure difference is generated between the vibration chambers and the external environment, the deformation of the diaphragms 13 can be controlled not by a change in the equilibrium position of each diaphragm 13 but by an immediate greater change in the equilibrium position of the deformable plate 14.

In the case of employing the configuration of this embodiment in an ejection head, the equilibrium position of each diaphragm 13 is prevented from being greatly changed by the pressure difference between the pressure inside the vibration chambers 21 and the pressure outside the liquid droplet ejecting head 10. Therefore, there is no need to perform pressure correction by changing the value of a driving voltage. Further, the amount and the velocity of ink droplets ejected from the liquid droplet ejecting head 10 are prevented from being changed by the pressure difference. Therefore, the liquid droplet ejecting head 10 can maintain stable ejection characteristics.

Further, according to this configuration, the pressure correcting part is provided side by side with the common liquid chamber 12, which is essential in the configuration of the head 10. Therefore, pressure correction, which is a task characteristic of the electrostatic liquid droplet ejecting heads, can be performed while minimizing an increase in the size of the head 10.

According to the graphically represented configuration of this embodiment, the vibration chambers 21 of the actuators are partitioned by the partition walls 21*a*, but share the pressure correcting chamber 23. Therefore, the vibration chambers 21 communicate with one another. However, this is only one configuration, and each actuator may have its own independent vibration chamber 21 and pressure correcting chamber 23. That is, the vibration chambers 21 of the actuators are prevented from communicating with one another, and so are the pressure correcting chambers 23 of the actuators. In this case, the configuration of this embodiment is also applicable so that the same effect can be obtained. In the case of the independent vibration chambers 21, however, each actuator should include the configuration of this embodiment.

Practically, the pressure inside the pressure liquid chambers 11, the channels 15 and the common liquid chamber 12 is set to be negative so as to prevent ink from leaking from the nozzle holes 31. The negative pressure is applied to both the diaphragms 13 and the deformable plate 14. Therefore, the above description holds without being affected by the presence of the negative pressure. The atmospheric pressure affects the diaphragms 13 and the deformable plate 14 through the liquid inside the head 10.

In order to cause the deformation of the deformable plate 14 to be greater than the total deformation of the diaphragms 13, it is necessary, as is seen from equation (1), to make the thickness t of the deformable plate 14 less than that of each diaphragm 13, or it is necessary to make the in-plane length that restrains the displacement of the deformable plate 14 longer than the in-plane length that restrains the displacement of each diaphragm 13. In the case of a rectangular deformable plate, the in-plane length refers to its width, or the length of its shorter side. Here, the employment of the latter configuration makes it possible to apply the process of forming the deformable plate 14 simultaneously with the diaphragms 13, so that an increase in the number of manufacturing processes and an accompanying increase in cost can be avoided.

When the initial equilibrium state of the volume (capacity) of the actuator chamber including all of the vibration chambers 21 communicating with the pressure correcting chamber 23 is expressed by an equation of state $P_0V_0=nRT_0$, the subsequent state where the temperature $T_0$ and the pressure $P_0$ in the initial equilibrium state are changed to T and P, respectively, can be expressed by PV=nRT. Then, the difference ΔV between the volumes $V_0$ and V before and after the state transition is given by:

$$\Delta V = V - V_0 = V_0\left(\frac{TP_0}{PT_0} - 1\right) \tag{2}$$

On the other hand, if the deformation δ of the central part of the rectangular deformable plate 14 in the direction of its width or shorter side is sufficiently small compared with the width or shorter side a (shown in FIG. 3) of each diaphragm 13 that is a rectangular thin plate, the deformation δ is given by the equation (1) with respect to the pressure P applied evenly to the deformable plate 14 extending in the direction to cross the diaphragms 13. At this point, letting the length (of the longitudinal side) b of the diaphragm 13 (shown in FIG. 4) be sufficiently greater than its width or shorter side a, the difference between the volumes before and after the deformation is given by:

$$W = \frac{1-v^2}{60E}\frac{a^5 \cdot b}{t^3}P \tag{3}$$

In the following, the material and configuration parameters of the diaphragms 13 are expressed by δ, v, E, a, and t, and the material and configuration parameters of the deformable plate 14 are expressed by δ', v', E', a', and t'.

The present invention is characterized in that the ejecting head 10 includes the deformable plate 14 as the pressure correcting part so that the equilibrium position of each diaphragm 13 remains substantially unchanged, thus causing no substantial change in its vibration characteristic, even if a difference is generated between the pressures inside and outside the actuator chamber.

For instance, in the normal usage of the liquid droplet ejecting head 10, if the atmospheric pressure varies from a standard value of 1013 hPa to 960 hPa and the temperature varies between zero and 50° C. with the standard value being 25° C., a condition to be satisfied by the deformable plate 14 is that a change in the volume of the actuator chamber due to the displacement of the deformable plate 14 in the case of a load of 53 hPa being applied evenly thereto is larger than or equal to $0.15 \times V_0$, which is obtained from the equation (2).

Meanwhile, the sum of a change in the volume of the actuator chamber due to the displacement of the deformable plate 14 and a change in the volume of the actuator chamber due to the displacement of the diaphragms 13 equals a change in the volume of the actuator chamber obtained from the equation of state. Therefore, the following equation (4) is derived.

$$\frac{1-v'^2}{60E'}\frac{a'^5 \cdot b'}{t'^3}(P_{out}-P_{in}) + \frac{1-v^2}{60E}\frac{a^5 \cdot b}{t^3}(P_{out}-P_{in})N = V_0\frac{T_0P_{in}-P_0T_{in}}{T_0P_{in}} \tag{4}$$

where $P_{out}$ is the atmospheric pressure of the external environment, $P_{in}$ is the pressure inside the vibration chambers 21, $T_0$ is the temperature in the initial equilibrium state, T is the temperature to which $T_0$ is changed, and N is the number of diaphragms.

Accordingly, another condition to be satisfied by the deformable plate 14 is that the value of the first term of the left-hand side of the equation (4) (the change in the volume of the actuator chamber due to the displacement of the deformable plate 14) is sufficiently larger than the value of the second term of the left-hand side of the equation (4) (the change in the volume of the actuator chamber due to the displacement of the diaphragms 13) under any environmental (temperature and pressure) conditions. It is under this condition that the equilibrium position of each diaphragm 13 is prevented from making a substantial change even if a difference is generated between the pressures inside and outside the vibration chambers 21. This condition can be satisfied easily by properly selecting the values of the material and configuration parameters of the actuators and the deformable plate 14.

A description will be given of an experiment for evaluating the liquid droplet ejecting head 10 according to the first embodiment of the present invention.

[Evaluation Method]

The evaluation method is as follows. That is, in addition to a first ejection head including actuators including the deformable plate 14 of the present invention, a second ejection head with actuators each having entirely the same configuration as those of the first ejection head except for the absence of the deformable plate 14 was fabricated for the purpose of comparison.

The first ejection head according to the present invention and the second ejection head for comparison were heated on a hot plate in an environmental test laboratory set at a temperature of 10° C. At this point, the air gap lengths of the first and second ejection heads were measured at predetermined temperatures as follows. In each of the first and second ejection heads, each actuator was driven to cause the diaphragm 13 to come into contact with the electrode 22 at each predetermined temperature, and the displacement of the diaphragm 13 at this point was measured by a laser Doppler vibrometer. That is, the measured value was the air gap length between the electrode 22 and the diaphragm 13.

In order to measure the displacement by the vibrometer, the measurement was performed in the state where no liquid was provided in the pressure liquid chambers 11 and the common liquid chamber 12 and the nozzle plate 3 was not joined to the channel substrate 1. The presence of liquid, however, will not greatly change the following results.

[Ejection Head]

The configuration of and the method of manufacturing the first ejection head according to the present invention are summarized as follows.

With respect to the electrode substrate 2, a plurality of parallel grooves for the vibration chambers 21 were formed on one side of a Si substrate, and an oxide film was formed inside each groove. Thereafter, a TiN film was formed on the oxide film so that the individual electrodes 22 were formed. Next, with respect to the channel substrate (vibration substrate) 1, the diaphragms 13, the common liquid chamber 12, and the accompanying deformable plate 14 were formed on one side of another Si substrate by etching. At this point, the diaphragms 13 and the deformable plate 14 were formed by exactly the same process. Thereafter, the electrode substrate 2 and the channel substrate 1 were directly joined. The number of actuators formed in the first ejection head (as well as in the second ejection head) in a row was 192. All of the vibration chambers 21 communicated with the single pressure correcting chamber 23.

[Specifications of the Diaphragm 13]

Each rectangular diaphragm 13 had the following specifications:

Thickness t: 2 μm

Width a: 125 μm

Length b: 1000 μm.

[Specifications of the Deformable Plate 14 Provided to the Common Liquid Chamber 12]

Thickness t': 2 μm

Width a': 2000 μm

Length b': 30 mm.

[Shape of the Electrode 22]

The electrodes 22 opposing the diaphragms 13 were formed to be parallel thereto. Further, the air gap length between the electrodes 22 and the diaphragms 13 is designed to be 0.2 μm in the specifications.

[Results]

Figure 5:
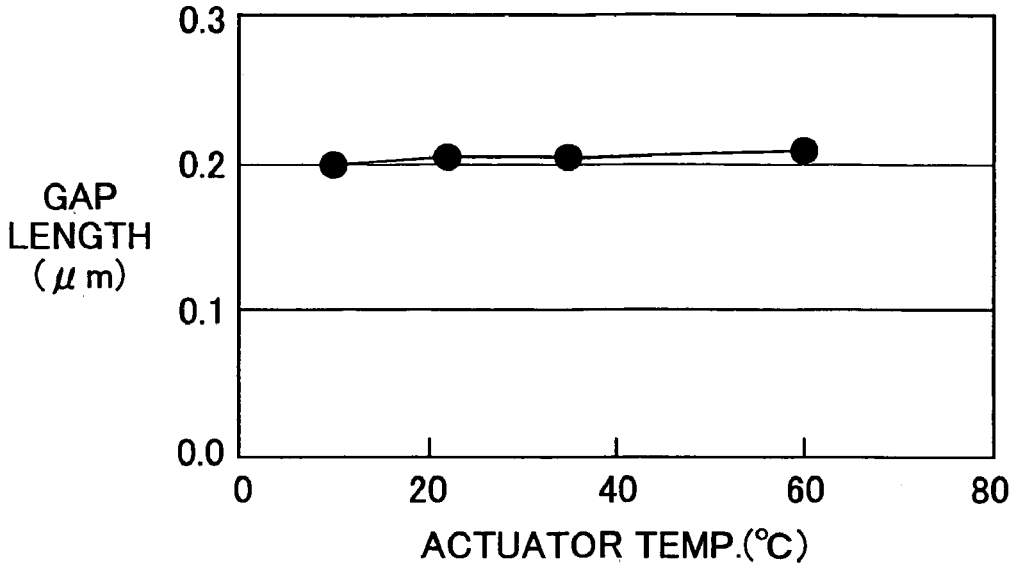
FIG. 5 is a graph showing the relationship between the air gap and temperature of an actuator according to the first embodiment of the present invention.
Figure 6:
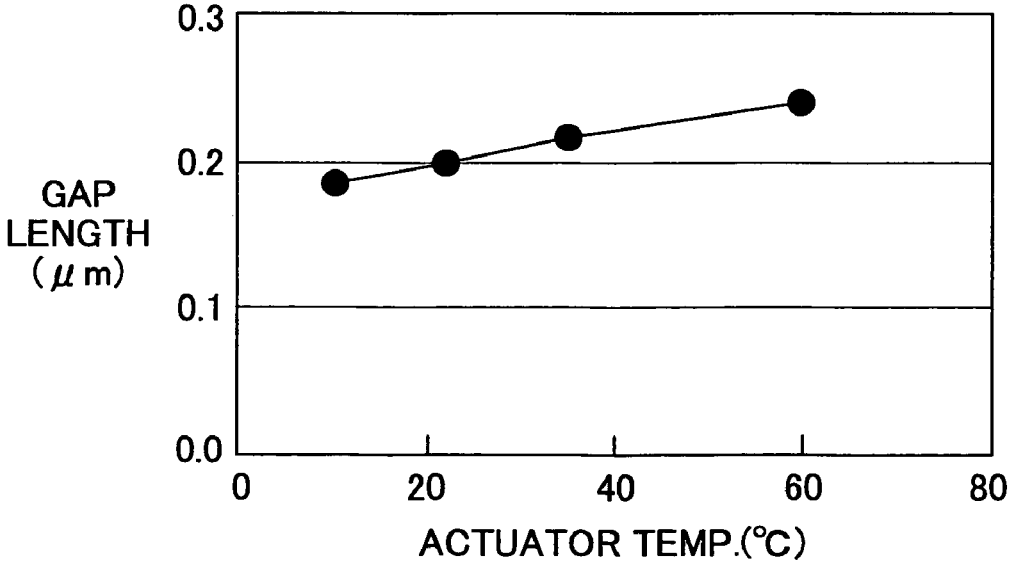
FIG. 6 is a graph showing the relationship between the air gap and temperature of an actuator for comparison.

FIGS. 5 and 6 are graphs showing the results of changes in the air gap length due to changes in temperature in the first ejection head according to the present invention and the second ejection head for comparison, respectively. In FIGS. 5 and 6, the vertical axis represents the air gap length (equal to the deformation of each diaphragm 13 at the time of contact with the corresponding electrode 22) and the horizontal axis represents temperature.

FIG. 6, which illustrates the relationship between the air gap length and temperature in each actuator of the second ejection head, shows that the air inside each actuator expands or contracts in accordance with temperature, causing clear changes in the air gap length. In the case of employing such an actuator in a printer, it is difficult to perform ink ejection stably against environmental changes without simultaneously using a part performing compensation, such as a part detecting temperature or pressure or a part correcting a driving voltage.

On the other hand, FIG. 5, which illustrates the relationship between the air gap length and temperature in each actuator of the first ejection head, shows no clear changes in the air gap length with respect to changes in temperature. This is because the deformable plate 14 having a lower rigidity than the diaphragms 13 is displaced with sufficiently more sensitivity that the diaphragms 13 in response to the expansion or contraction of the air (increase of decrease of the air pressure) inside the actuators so as to prevent the influence of the expansion or contraction of the air from causing the displacement of the diaphragms 13.

In this experiment, the diaphragms 13 and the deformable plate 14 were formed of the same material. Alternatively, in order to cause the deformation of the deformable plate 14 to be greater than the total deformation of the diaphragms 13, it is also possible to form the diaphragms 13 and the deformable plate 14 of different materials so that the material of the deformable plate 14 has a lower Young's modulus than that of the diaphragms 13.

Second Embodiment

Figure 7:
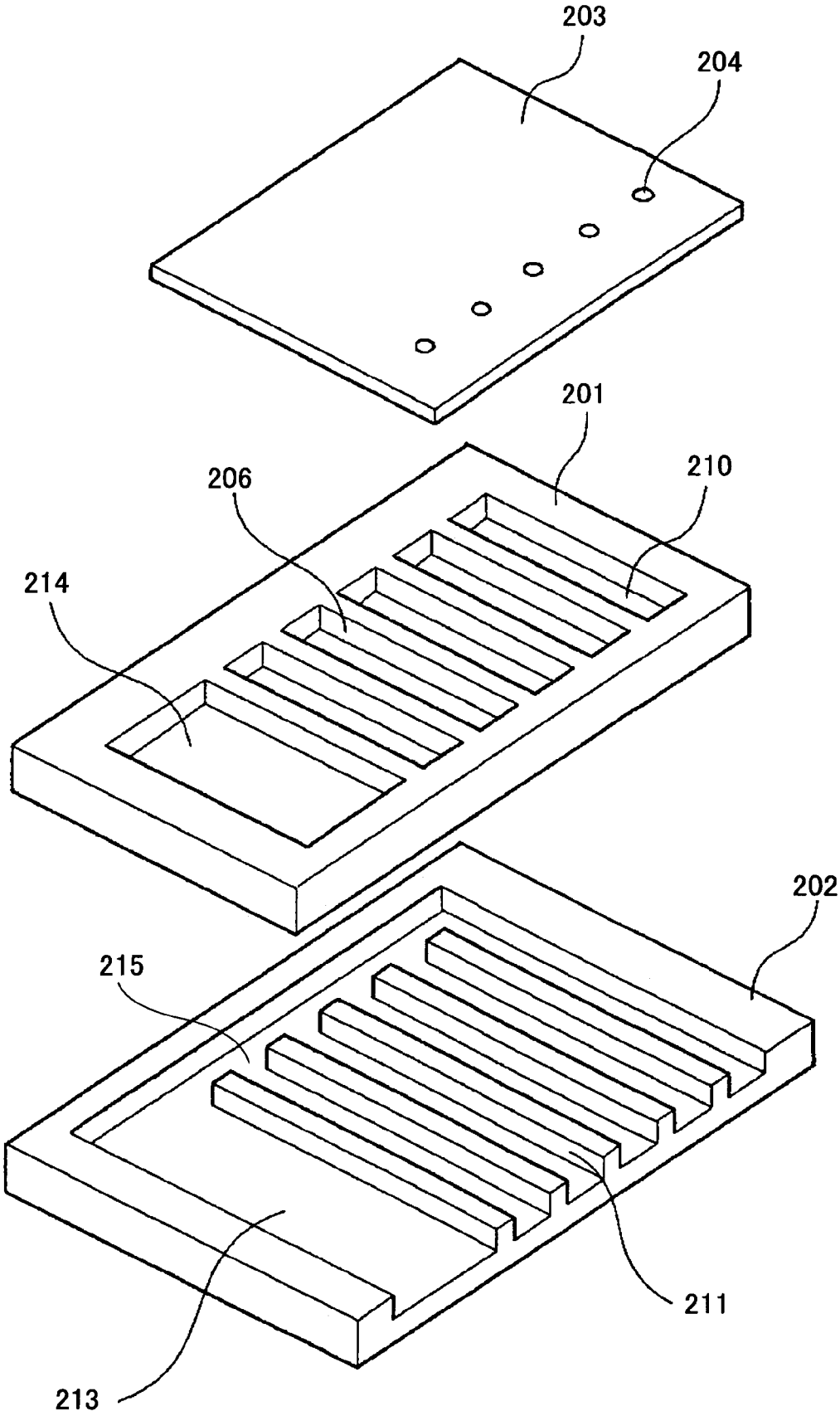
FIG. 7 is an exploded perspective view of an ink-jet head including an electrostatic actuator according to a second embodiment of the present invention.
Figure 8:
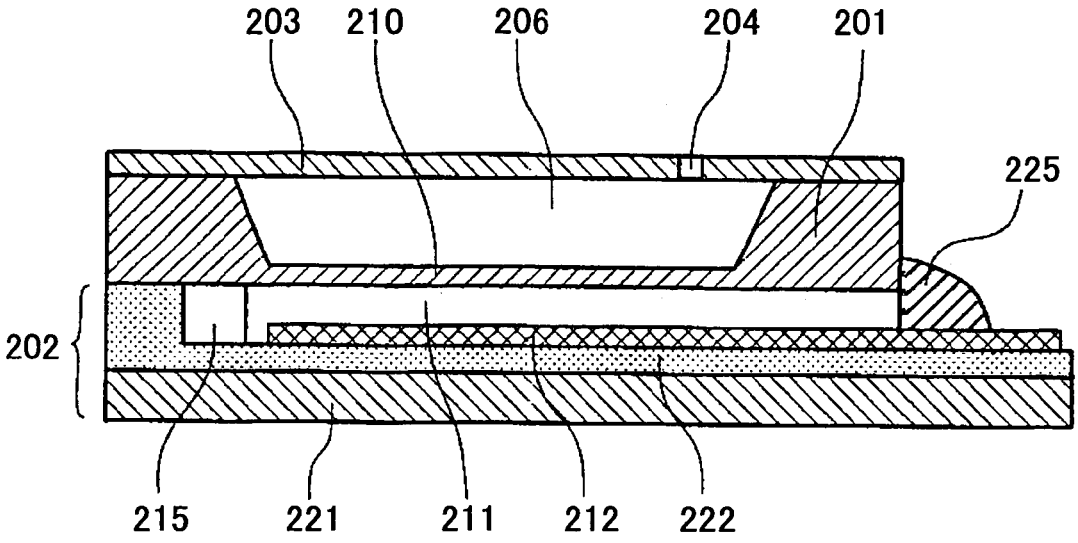
FIG. 8 is a sectional view of a pressure liquid chamber part of the ink-jet head taken along the length of a diaphragm according to the second embodiment of the present invention.
Figure 9:
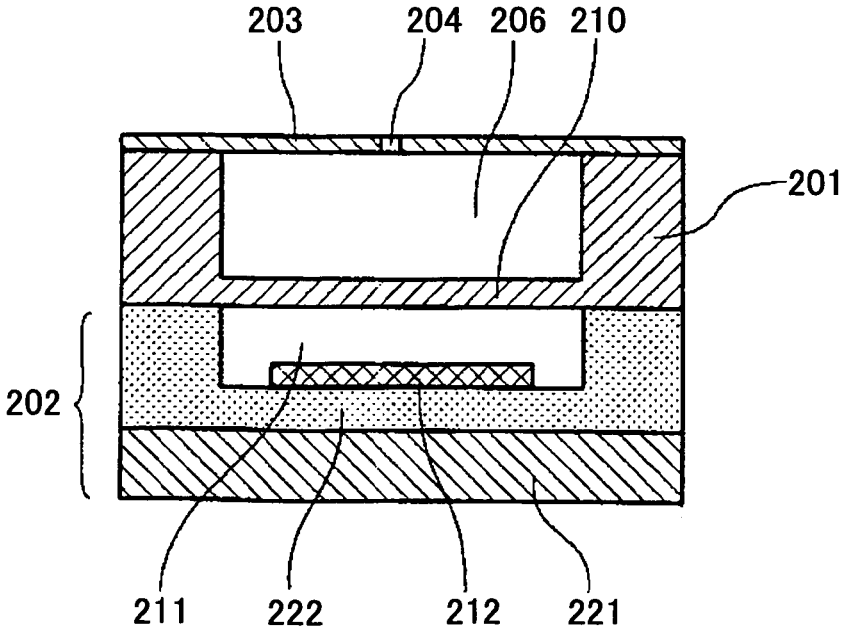
FIG. 9 is a sectional view of the pressure liquid chamber part of the ink-jet head taken along the width of the diaphragm according to the second embodiment of the present invention.
Figure 10:
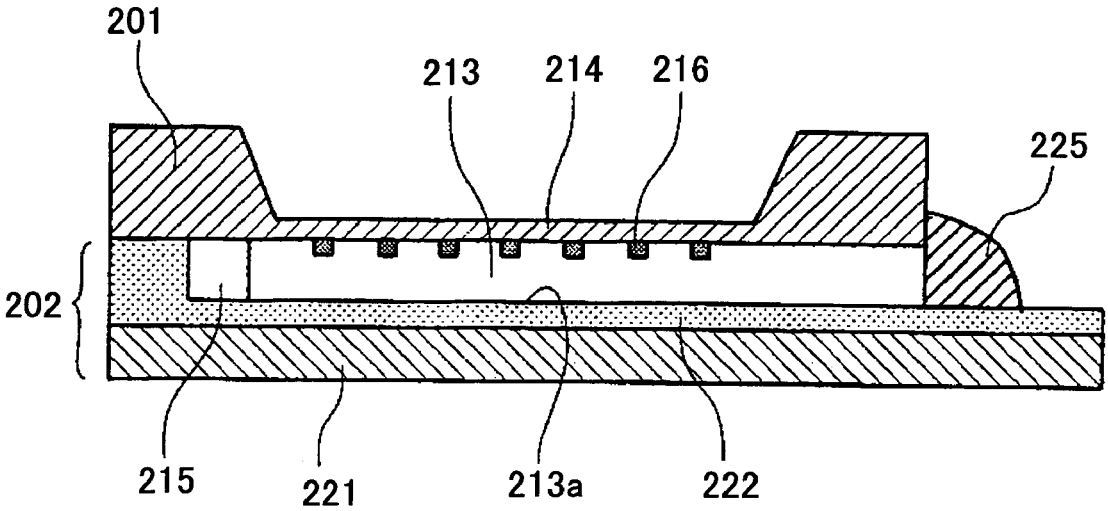
FIG. 10 is a sectional view of a pressure correcting part of the ink-jet head taken along the length of a deformable plate according to the second embodiment of the present invention.
Figure 11:
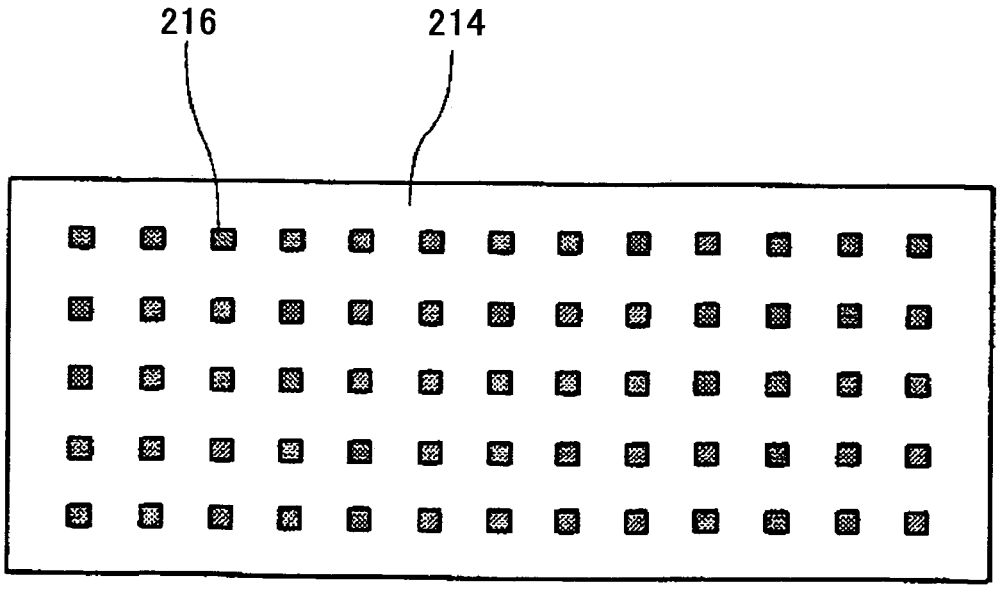
FIG. 11 is a plan view of the pressure correcting chamber side of the deformable plate of the ink-jet head according to the second embodiment of the present invention.

A description will be given, with reference to FIGS. 7 through 11, of an ink-jet head according to a second embodiment of the present invention. FIG. 7 is an exploded perspective view of the ink-jet head. FIG. 8 is a sectional view of a pressure liquid chamber part of the ink-jet head taken along the length of a diaphragm 210. FIG. 9 is a sectional view of the pressure liquid chamber part of the ink-jet head taken along the width of the diaphragm 210. FIG. 10 is a sectional view of a pressure correcting part of the ink-jet head taken along the length of a deformable plate 214. FIG. 11 is a plan view of the pressure correcting chamber side of the deformable plate 214 of the ink-jet head.

The ink-jet head of the second embodiment, which is a side-shooter-type head that ejects ink droplets from nozzle holes formed on the surface of a substrate, includes a layer structure formed by joining a channel substrate 201, an electrode substrate 202, and a nozzle substrate 203. The channel substrate 201 and the nozzle substrate 203 are joined to form a plurality of pressure liquid chambers 206 communicating with respective nozzle holes 204 ejecting ink droplets and a common liquid (ink) chamber (not shown in the drawings) supplying ink via fluid resistance parts to the pressure liquid chambers 206. The ink-jet head can be formed to be an edge-shooter-type head.

The channel substrate 201 and the electrode substrate 202 are joined so as to form: a plurality of vibration chambers 211 each having a face thereof formed by the corresponding diaphragm 210; a plurality of electrodes 212 each opposing the corresponding diaphragm 210 with a predetermined gap formed therebetween; a pressure correcting chamber 213 communicating with each vibration chamber 211 and having a face thereof formed by the deformable-plate 214 that is a deformable part that is displaced in accordance with the external atmospheric pressure; and a communication channel 215 that connects the pressure correcting chamber 213 with each vibration chamber 211. The electrostatic actuators of the ink-jet head according to this embodiment include the diaphragms 10, the vibration chambers 211, the electrodes 212, the pressure correcting chamber 213, the deformable plate 214, and the communication channel 215.

The channel substrate 201 is formed of a silicon substrate, for instance. A high-density p-type diffusion layer of B is formed in the silicon substrate, and anisotropic etching is performed on the substrate using a KOH aqueous solution. Thereby, recesses for the pressure liquid chambers 216 are formed simultaneously with the diaphragms 210 with the high-density p-type diffusion layer serving as an etching stop layer. Further, a recess is formed in the channel substrate 201 so that the bottom of the recess forms the deformable plate 214.

The electrode substrate 202 is formed of a silicon substrate 221. An insulating film 222 such as a silicon oxide film is formed on the silicon substrate 201, and recesses for vibration chambers 211 are formed in the insulating film 222. The electrodes 212 are formed on the bottom faces of the recesses so as to oppose the diaphragms 210. Further, a recess for the pressure correcting chamber 213 is formed in the insulating film 222. An insulating film (not shown in the drawing) such as a silicon oxide film is formed at least on the surface of each electrode 212 so as to prevent its contact with the diaphragm 210 from causing an electrical short circuit.

After joining the channel substrate 201 and the electrode substrate 202, the recesses for the vibration chambers 211 and the pressure correcting chamber 213 are sealed by a sealing agent 225 so that the vibration chambers 211 and the pressure correcting chamber 213 are formed separately from one another but connected by the communication channel 215.

The deformable plate 214 forming a wall face of the pressure correcting chamber 213 has a lower rigidity than each diaphragm 211 so as to be deformable and displaceable in accordance with a change in the external atmospheric pressure. As shown in FIGS. 10 and 11, a multitude of minute projections 216 that form a contact area reducing part reducing the area of contact of the deformable plate 214 at the time of its contact with a wall face 213*a* of the pressure correcting chamber 213 are formed on the lower surface of the deformable plate 214 on its pressure correcting chamber 213 side. The wall face 213*a* opposes the deformable plate 214.

The nozzle substrate 203 employs a Ni substrate of 50 μm in thickness, for instance. The nozzle holes 204 are formed on the surface of the nozzle substrate 203 so as to communicate with the corresponding pressure liquid chambers 206. The nozzle substrate 203 may be formed of another metallic or resin material or a plurality of layers of these materials.

In the ink-jet head having the above-described configuration, a pulse potential of zero to 40 V is applied to each electrode 212 by an oscillator circuit. When the surface of each electrode 212 is positively charged, the suction effect of electrostatic forces is exerted between the diaphragms 210 to which no pulse potential is applied and the electrodes 212. Thereby, the diaphragms 210 deflect toward the electrodes 212 so as to come into contact with the electrodes 212 via the insulating film (not shown in the drawing).

At this point, ink is supplied from the common liquid chamber via the fluid resistance parts to the pressure liquid chambers 206. Thereafter, by returning the potential applied to each electrode 212 to zero volts, the electrostatic forces exerted between the electrodes 212 and the diaphragms 210 become zero, causing the diaphragms 210 in a deflected state to return to their original state by their own restoring forces. At this point, the pressures inside the pressure liquid chambers 206 rapidly increase so that ink droplets are ejected from the nozzle holes 204.

At this point, if there is a difference generated between the pressures inside and outside the vibration chambers 211 due to a change in the external atmospheric pressure, the deformable plate 214, which has a lower rigidity than each diaphragm 210 so as to be deformable and displaceable in accordance with the external atmospheric pressure, deforms to control the deformation of the diaphragms 210. That is, when the pressure inside the vibration chambers 211 is higher than the external atmospheric pressure, the deformable plate 214 forming a wall face of the pressure correcting chamber 213 deforms to be displaced in the direction to increase the volume of the pressure correcting chamber 213, thereby controlling the deformation of the diaphragms 210. On the other hand, when the pressure inside the vibration chambers 211 is lower than the external atmospheric pressure, the deformable plate 214 deforms to be displaced in the direction to decrease the volume of the pressure correcting chamber 213, thereby controlling the deformation of the diaphragms 210.

In this case, the gap between the deformable plate 214 and the opposing wall face 213*a* of the pressure correcting chamber 213 is small so that the deformable plate 214 easily comes into contact with the opposing wall face 213*a*. However, because the minute projections 216 are formed on the lower surface of the deformable plate 214, the minute projections 216 come into contact with the opposing wall face 213*a* of the pressure correcting chamber 213. Therefore, the area of contact is significantly reduced compared with the case where the surface of the deformable plate 214 comes into direct contact with the opposing wall face 213*a* of the pressure correcting chamber 213.

Thus, the area of contact is reduced when the deformable plate 214 comes into contact with the opposing wall face 213*a* of the pressure correcting chamber 213 through the minute projections 216. Therefore, the cohesive forces by the van der Waals force exerted at the time of contact, absorption water, and a residual electric charge are substantially controlled, so that the sticking of the deformable plate 214 can be prevented. As a result, the function of the deformable plate 214, that is, the function of the pressure correcting chamber 213 can be prevented from being degraded, so that the correction operation can be performed stably for a long period of time. Further, since the gap between the surface of the deformable plate 214 and the opposing wall face 213*a* of the pressure correcting chamber 213 can be reduced, there is no increase in the size of the ink-jet head.

Thus, the ink-jet head of this embodiment includes the contact area reducing part provided to the deformable plate 214 of the pressure correcting chamber 213. Therefore, the ink-jet head can perform a stable correction operation so as to control a variation in the initial (equilibrium) position of each diaphragm 210 caused by the difference between the pressure inside the vibration chambers 211 and the external atmospheric pressure. Thereby, the ink-jet head can control a variation in its ink ejection characteristic, thus realizing stable liquid ejection. Thus, the ink-jet head having high accuracy and reliability is realized. Further, a micropump or an optical modulator device with high accuracy and reliability can be provided using the electrostatic actuator of the ink-jet head of this embodiment.

Figure 12A:
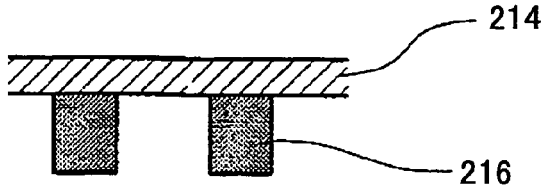
FIGS. 12A through 12C are diagrams showing vertical sectional shapes of minute projections according to the second embodiment of the present invention.
Figure 12B:
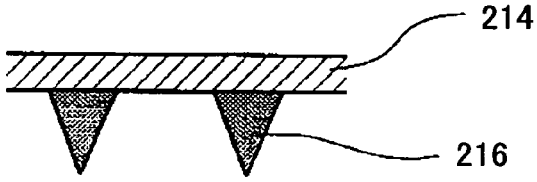
Figure 12C:
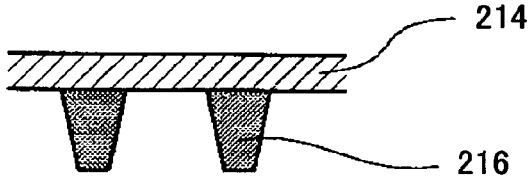

The shape of the minute projections 216 is not limited to a particular shape. FIGS. 12A through 12C are diagrams for illustrating variations of the shape of the minute projections 216. The minute projections 216 may be shaped so that their longitudinal (vertical) sections taken along the length of the deformable plate 214 are rectangular (quadrilateral) as shown in FIG. 12A, triangular as shown in FIG. 12B, or trapezoidal (wider on the deformable plate 214 side) as shown in FIG. 12C. In this case, in terms of production yield, structure stability, and the function of reducing the area of contact, it is particularly desirable that the minute projections 216 be shaped to have a trapezoidal section along the length of the deformable plate 214 so as to further reduce the area of contact.

Figure 13A:
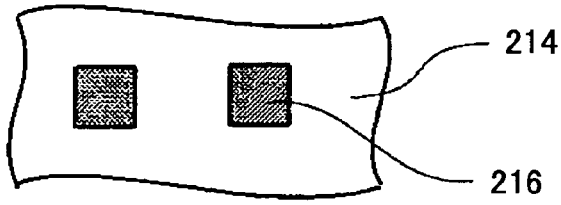
FIGS. 13A through 13C are diagrams showing horizontal sectional shapes of the minute projections according to the second embodiment of the present invention.
Figure 13B:
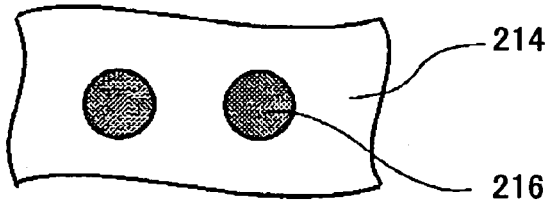
Figure 13C:
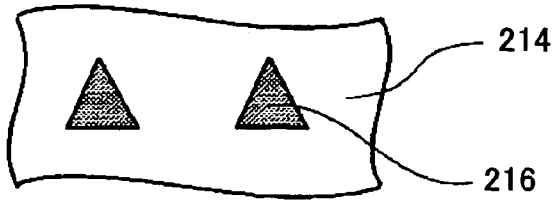
Figure 14:
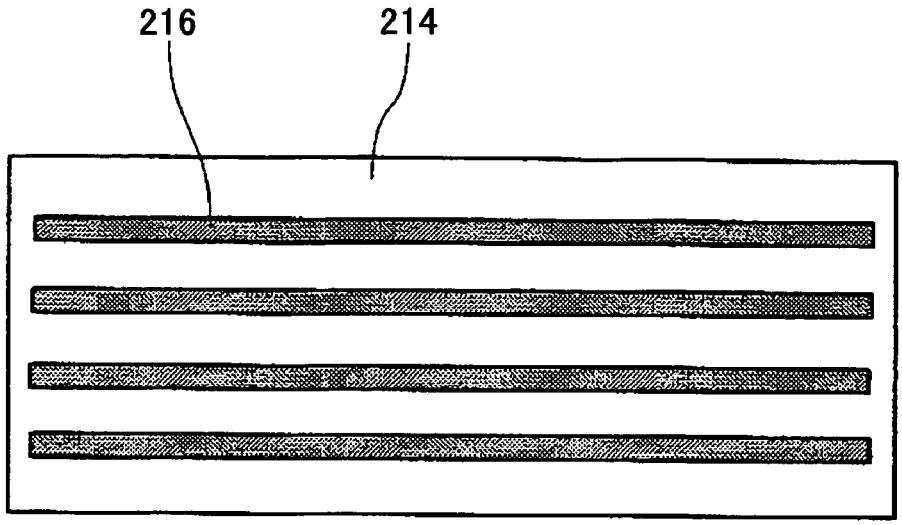
FIG. 14 is a diagram showing a shape and an arrangement of the minute projections according to the second embodiment of the present invention.

Further, the cross (horizontal) sections of the minute projections 216 taken along a plane parallel to the surface of the deformable plate 214 may be rectangular (quadrilateral) as shown in FIG. 13A, circular as shown in FIG. 13B, and triangular as shown in FIG. 13C. Further, the minute projections 216 are not limited to dot-like projections, but may be linear projections as shown in FIG. 14.

Further, the arrangement of the minute projections 216 is not limited to the one shown in FIG. 11. The minute projections 216 may be arranged in one or more rows, in a zigzag manner, annularly, or randomly. It is preferable that the minute projections 216 be arranged on the deformable plate 214 in consideration of the thickness and the width of the deformable plate 214 and the distance between the deformable plate 214 and the opposing wall face 213*a* of the pressure correcting chamber 213 so that the opposing wall face 213*a* comes into contact only with the minute projections 216 due to the pressure difference between the pressure correcting chamber 213 and the outside air.

Further, according to this embodiment, the vibration chambers 211 of the actuators communicate with one another in the ink-jet head. Alternatively, the present invention is also applicable to the case where the actuators have respective vibration chambers independent of one another. In the case of independent vibration chambers, however, the independent vibration chambers should be provided with respective pressure correcting chambers, and each pressure correcting chamber should include the contact area reducing part that reduces the area of contact of the deformable part.

In the case of providing minute projections also to the lower surface of each diaphragm 210 on its vibration chamber 211 side for the purpose of preventing the sticking of the diaphragms 210, the minute projections can be provided to the lower surface of each diaphragm 210 and the lower surface of the deformable plate 214 simultaneously, that is, using the same material by the same process. Thereby, an increase in the number of production processes can be prevented.

Here, the minute projections may be formed directly on the plane. Alternatively, grooves may be formed on the plane so that the remaining ungrooved parts serve as the minute projections.

Third Embodiment

Figure 15:
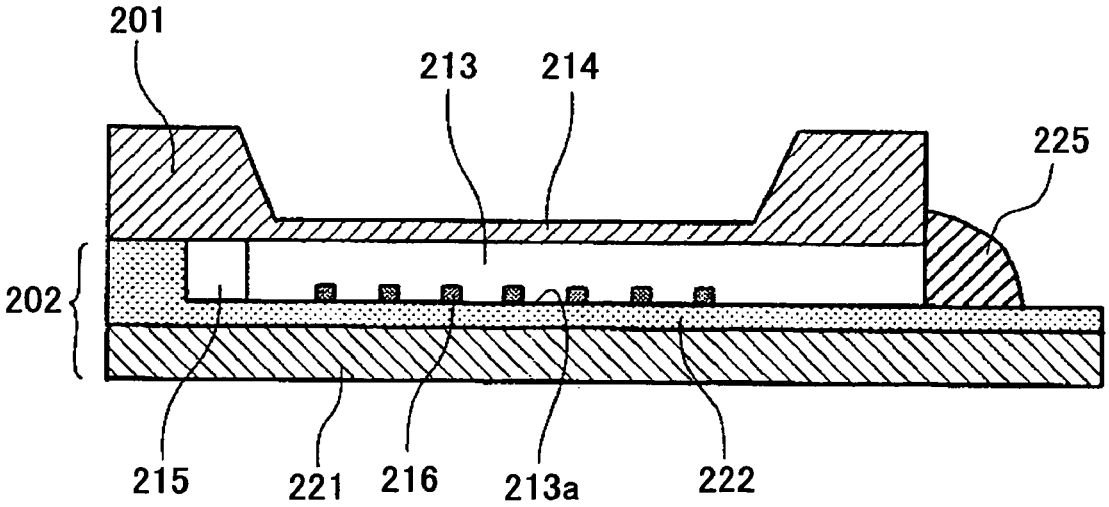
FIG. 15 is a sectional view of the pressure correcting part of an ink-jet head taken along the length of the deformable plate according to a third embodiment of the present invention.

Next, a description will be given, with reference to FIG. 15, of an ink-jet head according to a third embodiment of the present invention. FIG. 15 is a sectional view of the pressure correcting part of the ink-jet head taken along the length of the deformable plate 214. In FIG. 15, the same elements as those of the second embodiment are referred to by the same numerals, and a description thereof will be omitted.

According to the ink-jet head of the third embodiment, the minute projections 216 are formed on the wall face 213*a* of the pressure correcting chamber 213, the wall face 213*a* opposing the deformable plate 214. By this configuration, the same effect as in the second embodiment can be produced. This configuration is employable in the case where it is impossible or difficult to form the minute projections 216 on the deformable plate 214 according to the production process.

In the case of providing minute projections also to the upper surfaces of the electrodes 212 which upper surfaces oppose the diaphragms 210 for the purpose of preventing the sticking of the diaphragms 210, the minute projections can be provided to the upper surfaces of the electrodes 212 and the wall surface 213*a* of the pressure correcting chamber 213 simultaneously, that is, using the same material by the same process. Thereby, an increase in the number of production processes can be prevented.

Fourth Embodiment

Figure 16:
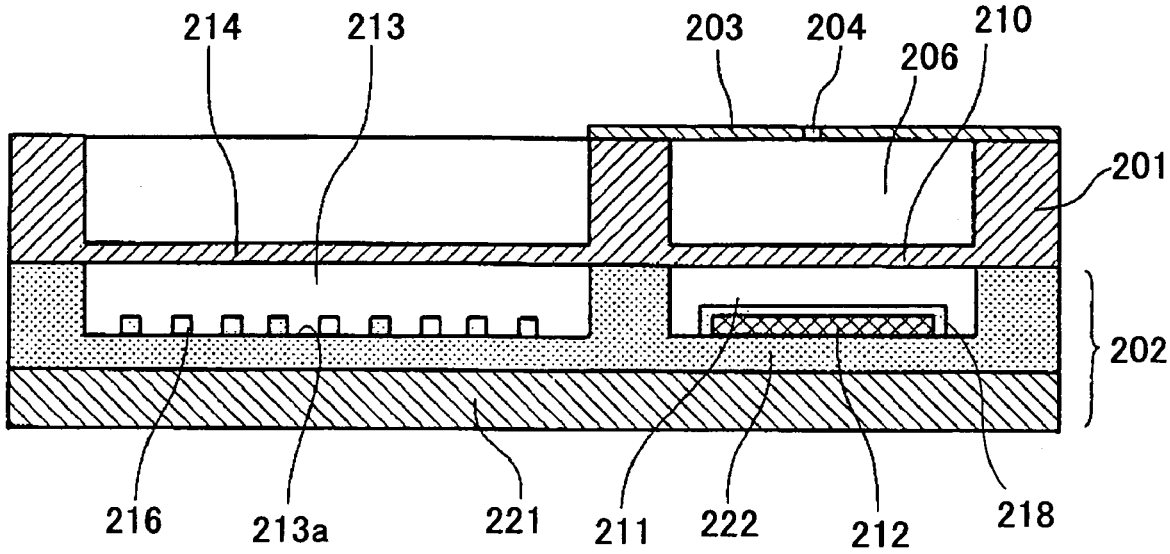
FIG. 16 is a sectional view of an ink-jet head taken along the width of the deformable plate, showing an important part of a pressure correcting part and vibration chambers according to a fourth embodiment of the present invention.

Next, a description will be given, with reference to FIG. 16, of an ink-jet head according to a fourth embodiment of the present invention. FIG. 16 is a sectional view of the ink-jet head taken along the width of the deformable plate 214, showing an important part of the pressure correcting part and the vibration chambers 211. In FIG. 16, the same elements as those of the second embodiment are referred to by the same numerals, and a description thereof will be omitted.

According to the ink-jet head of the fourth embodiment, an insulating film 218 is formed of a silicon oxide film on the surface of each electrode 212 which surface opposes the corresponding diaphragm 210. At the time of forming the insulating film 218, the minute projections 216 are formed of the silicon oxide film on the wall surface 213*a* opposing the deformable plate 214.

That is, it is preferable to employ semiconductor technology in forming a minute structure such as an ink-jet head. The simultaneous formation of the actuator part and the pressure correcting chamber can prevent an increase in the number of production processes and reduce production cost.

In this case, if the pressure correcting chamber 213 is formed simultaneously with the vibration chambers 211, then the configuration of the pressure correcting chamber 213 is subject to limitations. If the lower surface of the diaphragm 210 comes into contact with the opposing upper surface of the electrode 212 in each vibration chamber 211 when the actuators are driven, an insulating film should be formed on at least one of the upper surface of the electrode 212 and the lower surface of the diaphragm 210 so as to prevent an electrical short circuit from occurring. Even if the lower surface of the diaphragm 210 does not come into contact with the upper surface of the electrode 212, there still exists a risk of discharging. Therefore, the existence of the insulating layer increases the reliability of the ink-jet head. If the insulating layer is formed of silicon oxide (a silicon oxide film), a variety of semiconductor processes can be employed in forming the insulating layer.

Therefore, according to this embodiment, a silicon oxide film is formed as the insulating layer (film) 218 of the actuator part (vibration chambers 211) and at the same time, also formed in the pressure correcting chamber 213. Thereafter, in the pressure correcting chamber 213, the part of the insulating layer other than those corresponding to the minute projections 216 is removed by etching so that the minute projections 216 are formed.

Figure 17:
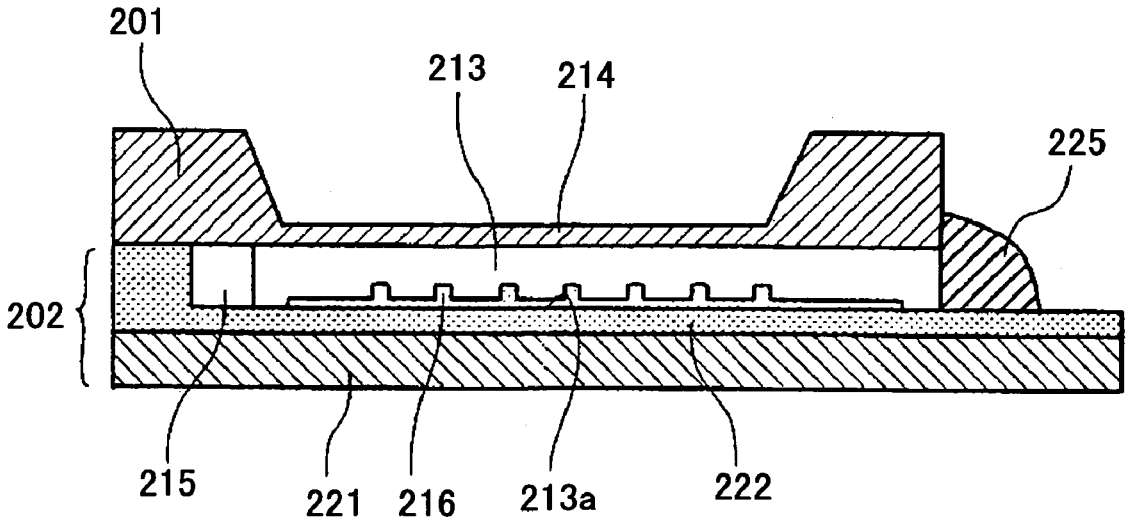
FIG. 17 is a sectional view of the pressure correcting part of the ink-jet head in the case of forming the minute projections without etching according to the fourth embodiment of the present invention.

In this case, the minute projections 216 may also be formed at the stage of forming the silicon oxide layer for the insulating film 218, that is, without etching. FIG. 17 is a sectional view of the pressure correcting part of the ink-jet head in this case.

It is not necessary that the insulating layer 218 of the actuator part and the insulating layer for the minute projections 216 of the pressure correcting chamber 213 be formed simultaneously. Nor is it necessary to employ silicon oxide for the insulating layer 218 of the actuator part even if the insulating layer for the minute projections 216 is formed of silicon oxide in the pressure correcting chamber 213.

In the case of forming an insulating layer on the diaphragms 210, it is preferable to employ silicon nitride as the insulating layer. In this case, it is preferable that the minute projections 216 be also formed of a silicon nitride film on the deformable plate 214 of the pressure correcting chamber 213.

If a silicon oxide film is formed on a part having low rigidity, a compressive stress is generated between the materials so as to deflect the low-rigidity part. The electrostatic actuator cannot have the desired characteristics unless the length of each diaphragm-electrode gap in which an electrostatic force is exerted is defined with accuracy. Therefore, if the low-rigidity part deflects due to the silicon oxide film so that the gap length changes to an undesired value, the electrostatic actuator is prevented from fully functioning.

On the other hand, the silicon nitride film is a film of tensile stress. Therefore, even if the silicon nitride film is formed on the low-rigidity part, the low-rigidity part is prevented from deflecting. Consequently, the diaphragm-electrode gap is prevented from changing, thereby preventing the function of the electrostatic actuator from being impaired.

Accordingly, as previously described, in the case of using silicon nitride as the insulating layer 218 necessary for the actuator part, a silicon nitride film may be formed simultaneously in the pressure correcting chamber 213 so that the silicon nitride film is used as material for the minute projections 216 in the pressure correcting chamber 213.

In this case, however, it is not necessary that the insulating layer 218 of the actuator part and the insulating layer for the minute projections 216 in the pressure correcting chamber 213 be formed simultaneously. Nor is it necessary that the insulating layer 218 of the actuator part be formed of a silicon nitride film even if the silicon nitride film is employed as material for the minute projections 216.

Next, a description will be given of specific configurations of the ink-jet head and their evaluations according to the present invention.

(First Configuration)

(1) Example Head

Figure 18A:
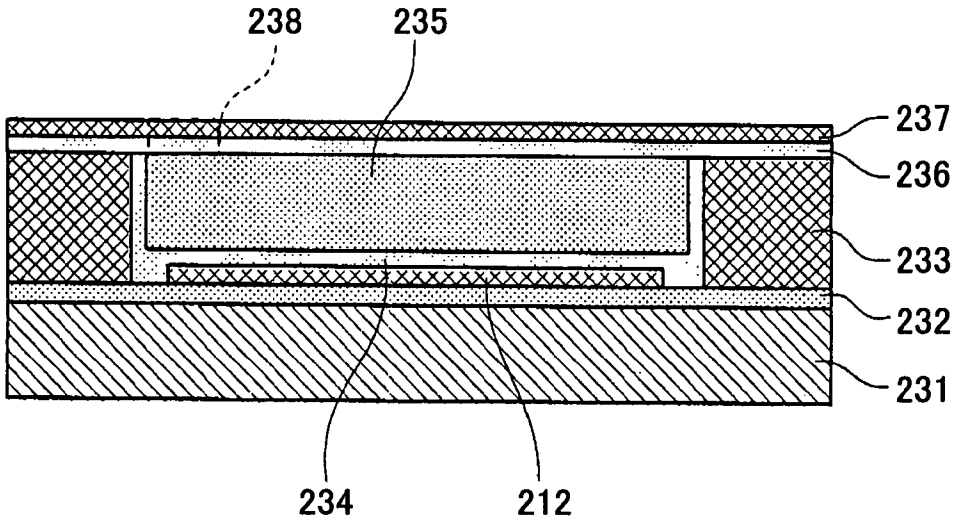
FIGS. 18A and 18B are diagrams for illustrating a method of forming the ink-jet head according to the fourth embodiment of the present invention.

A head according to the first configuration was formed by the following method so as to have the minute projections 216 formed therein. Here, a description will be given of this method with reference to FIGS. 18A and 18B. FIG. 18A is a sectional view of a one-bit actuator part of the head, and FIG. 18B is a sectional view of the pressure correcting chamber 213 of the head.

Referring to FIG. 18A, first, a $SiO_2$ film 232 is formed on a silicon substrate 231. Next, after a polysilicon layer 233 for the electrode 212 and partition walls is formed, a groove is formed in the polysilicon layer 233 by etching so that a SiN layer 234 can be formed therein. Thereby, the electrode 212 is formed of the polysilicon layer 233. At this point, the electrode 212 is formed so as to be electrically independent in each actuator (part). Thereafter, the SiN layer 234 is formed by CVD, and the groove is filled with a $SiO_2$ layer 235. Then, after the surface of the above-described structure is polished, a SiN layer 236 is formed on the polished surface of the structure, and a polysilicon layer 237 is formed on the SiN layer 236. Thereafter, the internal $SiO_2$ layer 235 is removed by etching through holes 238 formed as shown in FIG. 18A, so that the vibration chamber 211 is formed.

Figure 18B:
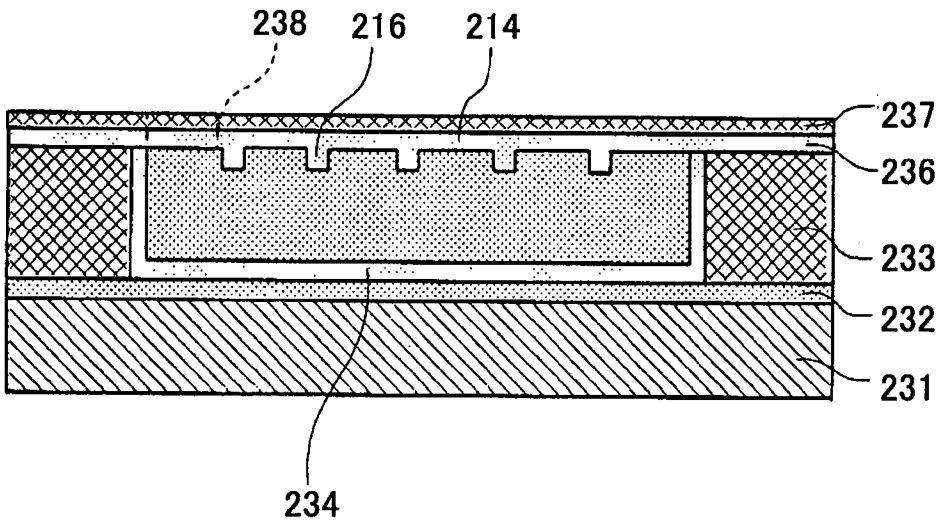

Referring to FIG. 18B, the pressure correcting chamber 213 is formed by substantially the same process as the actuator part. The differences lie in that: the polysilicon layer 233 in the part corresponding to the bottom surface of the pressure correcting chamber 213 is removed because no electrode 212 is formed; and recesses are formed at the positions where the minute projections 216 are to be formed on the polished surface of the structure formed after the formation of the $SiO_2$ layer 235, and thereafter, the SiN layer 236 and the polysilicon layer 237 are successively formed. Thereby, the deformable plate 214 integrated with the minute projections 216 is formed of the SiN layer 236, and by removing the $SiO_2$ layer 235, the pressure correcting chamber 213 is formed with the deformable plate 214 having the minute projections 216 formed on its lower surface.

The parameters of the parts of the head according to the first configuration were as follows.

Diaphragms: thickness t=2 μm; width a=125 μm; and length b=1000 μm.

Deformable plate: thickness t=2 μm; width a=2000 μm; and length b=10 mm.

Electrode shape: The electrodes 212 were formed parallel to the diaphragms 210. The electrode-diaphragm air gap length was designed to be 0.2 μm in specifications.

Minute projections: vertical dimension (height) t=0.2 μm; and area=3×3 μm. The minute projections 216 were formed on the lower surface of the deformable plate 214, arranged in a matrix-like manner with 60-μm vertical and horizontal pitches.

(2) Comparable Head

A comparable head to be compared with the example head according to the first configuration was formed so as to include no minute projections 216 by basically the same process as the example head. Since no minute projections 216 were formed in the comparable head, after polishing the surface of the structure formed after the formation of the $SiO_2$ layer 235, the SiN layer 236 was formed directly on the polished surface of the structure without forming recesses for the minute projections 216 on the polished surface.

(3) Evaluation Method and Results

The evaluation of the first configuration was performed as follows. With respect to each of a plurality of example heads and each of a plurality of comparable heads, the deformable plate 214 of the head was pressed with a needle in the atmosphere and caused to come into contact with the opposing wall face 213*a*. Thereafter, it was observed whether the deformable plate 214 stuck to the opposing wall face 213*a*.

The evaluation results show that no sticking occurred in the example heads according to the first configuration, while sticking occurred almost certainly in the comparable heads.

It is considered that sticking was mainly caused by an interatomic force, a liquid-bridge force, and a hydrogen-bond force. If such sticking occurs in the deformable plate 214, a desired pressure correction cannot be obtained, thereby making the head unreliable.

(Second Configuration)

(1) Example Head

A head according to the second configuration was formed by the following method so as to have the minute projections 216 formed therein. That is, after forming an oxide film on a silicon substrate, grooves were formed on the oxide film. The electrodes 212 were formed of a TiN film in the grooves, and a silicon oxide film was formed on the electrodes 212 as the insulating layer 218. Here, no TiN film was formed in the pressure correcting chamber 213 although the pressure correcting chamber 213 was allowed to have a TiN film formed therein. Etching was performed on the silicon oxide film in the pressure correcting chamber 213 so as to form the minute projections 216. Thereby, this substrate was formed into the electrode substrate 202.

Meanwhile, the diaphragms 210, the common liquid chamber, and the accompanying deformable plate 214 were formed in another silicon substrate by etching. This substrate serves as the channel substrate 201. At this point, the diaphragms 210 and the deformable plate 214 were formed by exactly the same process.

Thereafter, the channel substrate 201 was joined directly to the upper side of the electrode substrate 202. The number of actuators formed in a row in each head was 192. Here, all of the vibration chambers 211 in a row were formed to communicate with the single pressure correcting chamber 213.

The parameters of the parts of the head according to the second configuration were as follows.

Diaphragms: thickness t=2 μm; width a=125 μm; and length b=1000 μm.

Deformable plate: thickness t=2 μm; width a=2000 μm; and length b=10 mm.

Electrode shape: The electrodes 212 were formed parallel to the diaphragms 210. The electrode-diaphragm air gap length was designed to be 0.2 μm in specifications.

Minute projections: vertical dimension (height) t=0.2 μl; and area=3×3 $\mu m^2$. The minute projections 216 were formed on the wall face 213*a* of the pressure correcting chamber 213 opposite the deformable plate 214, arranged in a matrix-like manner with 60-μm vertical and horizontal pitches.

(2) Comparable Head

A comparable head to be compared with the example head according to the second configuration was formed so as to include no minute projections 216 by basically the same process as the example head. Since no minute projections 216 were formed, the process of forming the minute projections 216 was not performed in forming the electrode substrate 202.

(3) Evaluation Method and Results

The evaluation of the second configuration was performed as follows. With respect to each of a plurality of example heads and each of a plurality of comparable heads, the deformable plate 214 of the head was pressed with a needle in the atmosphere and caused to come into contact with the opposing wall face 213*a*. Thereafter, it was observed whether the deformable plate 214 stuck to the opposing wall face 213*a*.

The evaluation results show that no sticking occurred in the example heads according to the second configuration, while sticking occurred almost certainly in the comparable heads.

Fifth Embodiment

Figure 19:
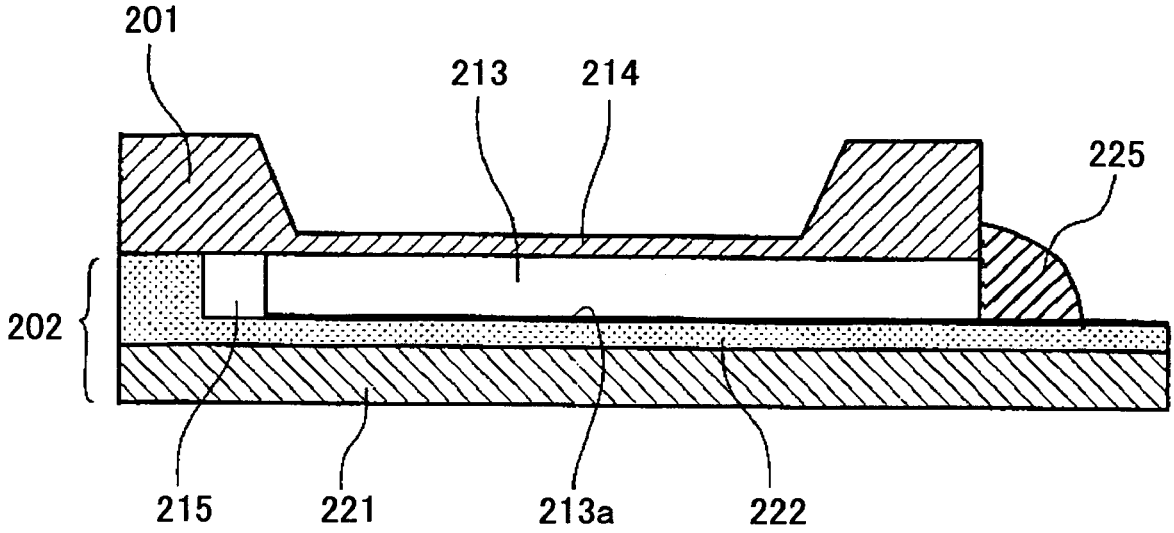
FIG. 19 is a sectional view of the pressure correcting part of an ink-jet head taken along the length of the deformable plate according to a fifth embodiment of the present invention.

Next, a description will be given, with reference to FIG. 19, of an ink-jet head according to a fifth embodiment of the present invention. FIG. 19 is a sectional view of the pressure correcting part of the ink-jet head taken along the length of the deformable plate 214. In FIG. 19, the same elements as those of the second embodiment are referred to by the same numerals, and a description thereof will be omitted.

According to the ink-jet head of the fifth embodiment, surface roughening is performed on the wall face 213*a* of the pressure correcting chamber 213 so as to increase the surface roughness of the wall face 213*a*. In this case, the surface roughness of the wall face 213*a* opposing the deformable plate 214 is equal to the internal surface roughness of the vibration chamber 211 if surface roughening is also performed on the internal surfaces of the vibration chambers 211 or larger than the internal surface roughness of the vibration chambers 211 if surface roughening is not performed on the internal surfaces of the vibration chambers 211.

Thus, by performing surface roughening on the wall face 213*a* of the pressure correcting chamber 213 with which wall face 213*a* the deformable plate 214 comes into contact, the area of contact of the deformable plate 214 at the time of its contact with the opposing wall face 213*a* can be reduced. Since the area of contact of the deformable plate 214 at the time of its contact with the opposing wall face 213*a* is reduced as in the above-described second through fourth embodiments, the cohesive forces by the van der Waals force exerted at the time of contact, absorption water; and a residual electric charge are substantially controlled, so that the sticking of the deformable plate 214 can be prevented. As a result, the function of the deformable plate 214, that is, the function of the pressure correcting chamber 213 can be prevented from being degraded, so that the correction operation can be performed stably for a long period of time.

Next, a description will be given of a specific configuration of the ink-jet head and its evaluation according to the present invention.

(Third Configuration)

(1) Example Head

A head according to the third configuration was formed by basically the same method as the example head according to the second configuration. Instead of the process of forming the minute projections 216, however, the surface roughening process of roughening the surface (the wall face 213*a*) opposing the deformable plate 214 by dry etching using Ar gas was performed.

The parameters of the parts of the head according to the third configuration were as follows.

Diaphragms: thickness t=2 μm; width a=125 μm; and length b=1000 μm.

Deformable plate: thickness t=2 μm; width a=1000 μm; and length b=10 mm.

Electrode shape: The electrodes 212 were formed parallel to the diaphragms 210. The electrode-diaphragm air gap length was designed to be 0.2 μm in specifications.

(2) Comparable Head

A comparable head to be compared with the head according to the third configuration was formed by basically the same method as the example head. However, no minute projections 216 were formed, nor was surface roughening performed on the opposing wall face 213*a*.

(3) Evaluation Method and Results

The evaluation of the third configuration was performed as follows. With respect to each of a plurality of example heads and each of a plurality of comparable heads, the deformable plate 214 of the head was pressed with a needle in the atmosphere and caused to come into contact with the opposing wall face 213*a*. Thereafter, it was observed whether the deformable plate 214 stuck to the opposing wall face 213*a*.

The evaluation results show that no sticking occurred in the example heads according to the third configuration, while sticking occurred almost certainly in the comparable heads.

Sixth Embodiment

Figure 20:
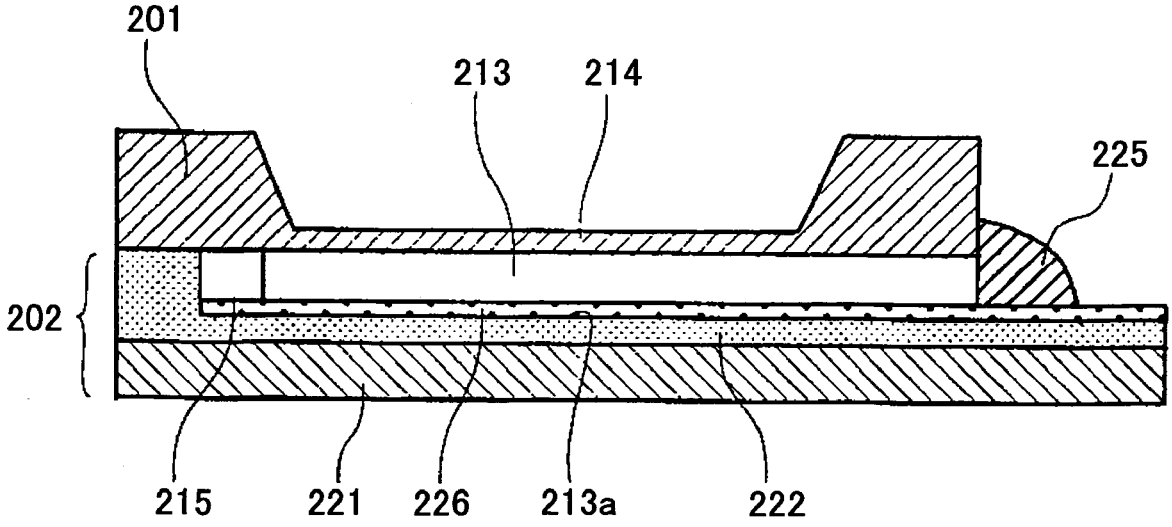
FIG. 20 is a sectional view of the pressure correcting part of an ink-jet head taken along the length of the deformable plate according to a sixth embodiment of the present invention.

Next, a description will be given, with reference to FIG. 20, of an ink-jet head according to a sixth embodiment of the present invention. FIG. 20 is a sectional view of the pressure correcting part of the ink-jet head taken along the length of the deformable plate 214. In FIG. 20, the same elements as those of the second embodiment are referred to by the same numerals, and a description thereof will be omitted.

According to the ink-jet head of the sixth embodiment, a hydrophobic film 226 is formed on the wall face 213*a* of the pressure correcting chamber 213, the wall face 213*a* opposing the deformable plate 214. Perfluorodecanoic acid (PFDA) or hexamethyldisilazane (HMDS) may be used as material for the hydrophobic film 226. HMDS, which has smaller molecules than PFDA, is suitable for forming a film in a narrow space.

Thus, by forming the hydrophobic film 226 on the wall face 213*a* with which the deformable plate 214 comes into contact, sticking due to a liquid-bridge force or a hydrogen-bond force (or sticking due to absorbed water) can be prevented. As a result, the function of the deformable plate 214, that is, the function of the pressure correcting chamber 213 can be prevented from being degraded, so that the correction operation can be performed stably for a long period of time.

Next, a description will be given of a specific configuration of the ink-jet head and its evaluation according to the present invention.

(Fourth Configuration)

(1) Example Head

A head according to the fourth configuration was formed by basically the same process as the example head according to the second configuration. However, no minute projections 216 were formed, and after joining the channel substrate 201 and the electrode substrate 202, the head structure was dipped into an HMDS solution so that an HMDS film was formed in the pressure correcting chamber 213 as the hydrophobic film 226.

The parameters of the parts of the head according to the fourth configuration were-as follows.

Diaphragms: thickness t=2 μm; width a=125 μm; and length b=1000 μm.

Deformable plate: thickness t=2 μm; width a=300 μm; and length b=10 mm.

Electrode shape: The electrodes 212 were formed parallel to the diaphragms 210. The electrode-diaphragm air gap length was designed to be 0.2 μm in specifications.

(2) Comparable Head

A comparable head to be compared with the head according to the fourth configuration was formed by basically the same process as the example head. However, the hydrophobic film 226 was not formed.

(3) Evaluation Method and Results

The evaluation of the fourth configuration was performed as follows. With respect to each of a plurality of example heads and each of a plurality of comparable heads, the deformable plate 214 of the head was pressed with a needle in the atmosphere and caused to come into contact with the opposing wall face 213*a*. Thereafter, it was observed whether the deformable plate 214 stuck to the opposing wall face 213*a*.

Next, in an environmental test laboratory set at a temperature of 30° C. and a relative humidity of 60%, after leaving the heads according to the fourth configuration and the comparable heads for an hour, the deformable plate 214 of each head was pressed with a needle in the atmosphere and caused to come into contact with the opposing wall face 213*a*. Thereafter, it was observed whether the deformable plate 214 stuck to the opposing wall face 213*a*.

According to the evaluation results, in the comparable heads, sticking did not occur in the atmosphere, but occurred in the environmental test laboratory. Meanwhile, no sticking occurred in the example heads according to the fourth configuration in either the atmosphere or the environmental test laboratory.

Seventh Embodiment

Figure 21:
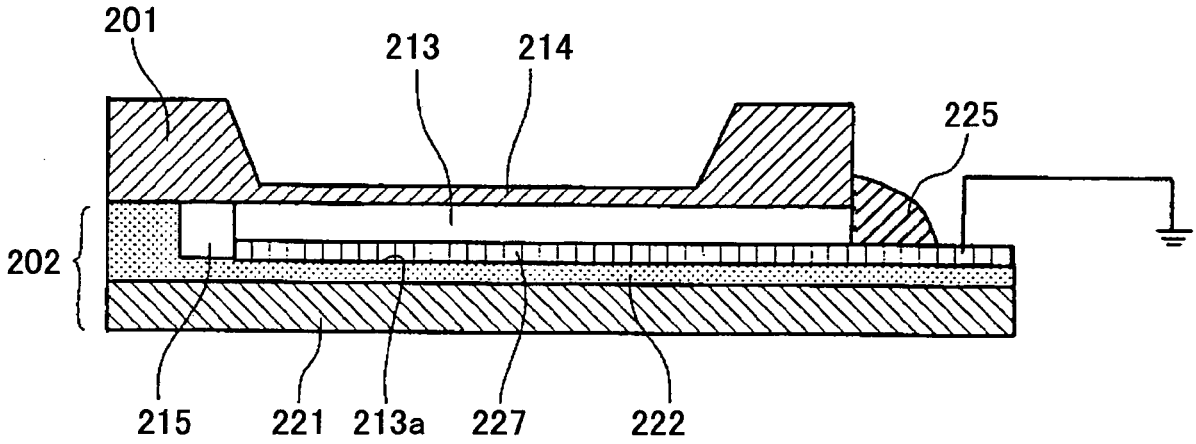
FIG. 21 is a sectional view of the pressure correcting part of an ink-jet head taken along the length of the deformable plate according to a seventh embodiment of the present invention.

Next, a description will be given, with reference to FIG. 21, of an ink-jet head according to a seventh Embodiment of the present invention. FIG. 21 is a sectional view of the pressure correcting part of the ink-jet head taken along the length of the deformable plate 214. In FIG. 21, the same elements as those of the second embodiment are referred to by the same numerals, and a description thereof will be omitted.

According to the ink-jet head of the seventh embodiment, a conductive layer (conductive film) 227 is formed on the wall face 213*a* of the pressure correcting chamber 213, the wall face 213*a* opposing the deformable plate 214. A metallic material such as TiN or a semiconductor material such as polysilicon may be used for the conductive layer 227. The conductive layer 227 is connected to ground (that is, grounded).

Thus, by forming the conductive layer 227 on the wall face 213*a* with which the deformable plate 214 comes into contact, an electrostatic charge generated in the contact region for some reason and considered to be a cause of sticking can be discharged, so that sticking caused by the electrostatic charge can be prevented. As a result, the function of the deformable plate 214, that is, the function of the pressure correcting chamber 213 can be prevented from being degraded, so that the correction operation can be performed stably for a long period of time.

Next, a description will be given of a specific configuration of the ink-jet head and its evaluation according to the present invention.

(Fifth Configuration)

(1) Example Head

A head according to the fifth configuration was formed by basically the same process as the example head according to the third configuration. In this case, however, a TiN layer was formed in the pressure correcting chamber 213 as the conductive layer 227 simultaneously with the formation of the electrode 212 in each actuator. Thereafter, before the direct joining of the channel substrate 201 and the electrode substrate 202, the oxide film of the TiN layer was removed by dry etching before the direct joining of the channel substrate 201 and the electrode substrate 202.

The parameters of the parts of the head according to the fifth configuration were as follows.

Diaphragms: thickness t=2 μm; width a=125 μm; and length b=1000 μm.

Deformable plate: thickness t=2 μm; width a=300 μm; and length b=10 mm.

Electrode shape: The electrodes 212 were formed parallel to the diaphragms 210. The electrode-diaphragm air gap length was designed to be 0.2 μm in specifications.

(2) Evaluation Method and Result

A potential difference was provided between the TiN layer (conductive layer 227) of the pressure correcting chamber 213 and the deformable plate 214 so that the deformable plate 214 was caused to come into contact with the TiN layer by electrostatic attraction. Thereafter, when the deformable plate 214 and the TiN layer were set in a direct float state, the deformable state 214 remained stuck to the wall face 213*a* of the pressure correcting chamber 213. However, when the TiN layer was grounded, it was observed that the deformable plate 214 was released from the opposing wall face 213*a* and the sticking was eliminated.

Eighth Embodiment

Figure 22:
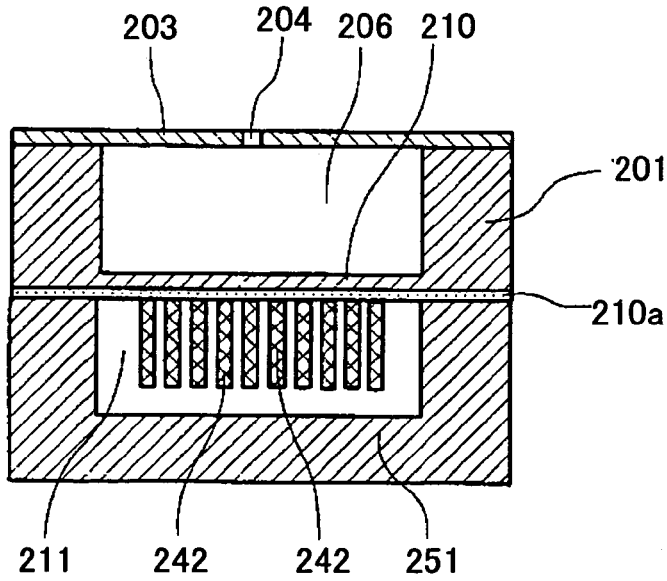
FIG. 22 is a sectional view of an actuator part of an electrostatic head taken along the width of the diaphragm according to an eighth embodiment of the present invention.

Next, a description will be given, with reference to FIG. 22, of an electrostatic head according to an eighth embodiment of the present invention. FIG. 22 is a sectional view of an actuator part of the electrostatic head taken along the width of the diaphragm 210. In FIG. 22, the same elements as those of the second embodiment are referred to by the same numerals, and a description thereof will be omitted.

Referring to FIG. 22, the electrostatic head of the eighth embodiment includes a plurality of electrodes 242 formed on an insulating film 210*a* formed on the opposite side of the diaphragm 210 from the pressure liquid chamber 206.

The electrodes 242 are individual structures that are electrically isolated from the diaphragm 210 and from one another.

According to this electrostatic head, when a pulse potential of zero to 40 V is applied to one of any adjacent two of the electrodes 242 and a pulse potential of zero volts is applied to the other one of the adjacent electrodes 242, an electrostatic force is generated between the adjacent electrodes 242 so that their free ends attract each other, causing the diaphragm 10 to deflect toward the pressure liquid chamber 206. Thereby, the pressure inside the pressure liquid chamber 206 rapidly increases so that an ink droplet is ejected.

In this electrostatic head, as in the above-described embodiments, a pressure correcting chamber communicating with the vibration chambers 211 may also be provided so that at least a surface of the pressure correcting chamber is formed by a deformable part that is deformable in accordance with the external atmospheric pressure. Further, a part that reduces the area of the contact of the deformable part and the surface of the pressure correcting chamber which surface opposes the deformable part may be provided. Thereby, the electrostatic head can perform liquid ejection stably for a long period of time.

Ninth Embodiment

Figure 23:
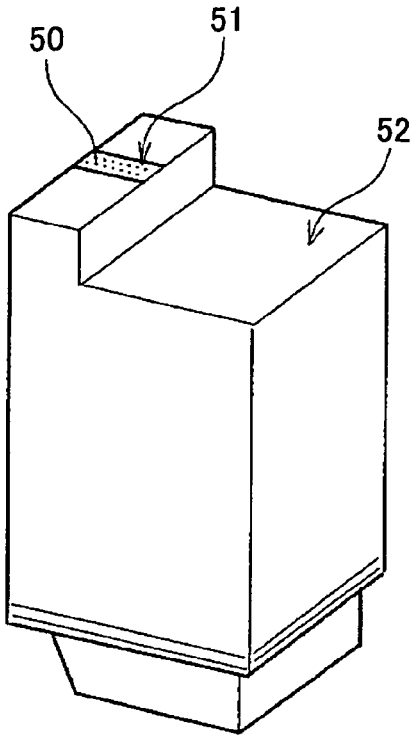
FIG. 23 is a perspective view of an ink cartridge according to a ninth embodiment of the present invention.

Next, a description will be given, with reference to FIG. 23, of an ink cartridge (a liquid supply cartridge) according to a ninth embodiment of the present invention. The ink cartridge of the ninth embodiment is formed by integrating an ink-jet head (a liquid droplet ejecting head) 51 according to any of the above-described first through eighth embodiments and an ink tank 52 supplying ink to the ink jet head 51. The ink-jet head 51 includes a plurality of nozzles 50. The high-performance ink-jet head 51 as described in any of the above-described embodiments is integrated into the ink cartridge, thereby adding to the total value of the ink-jet head 51. According to this embodiment, an ink cartridge (a head integrated with an ink tank) integrating a liquid droplet ejecting head having stable droplet ejecting characteristics and-high reliability can be obtained at reduced cost.

Tenth Embodiment

Figure 24:
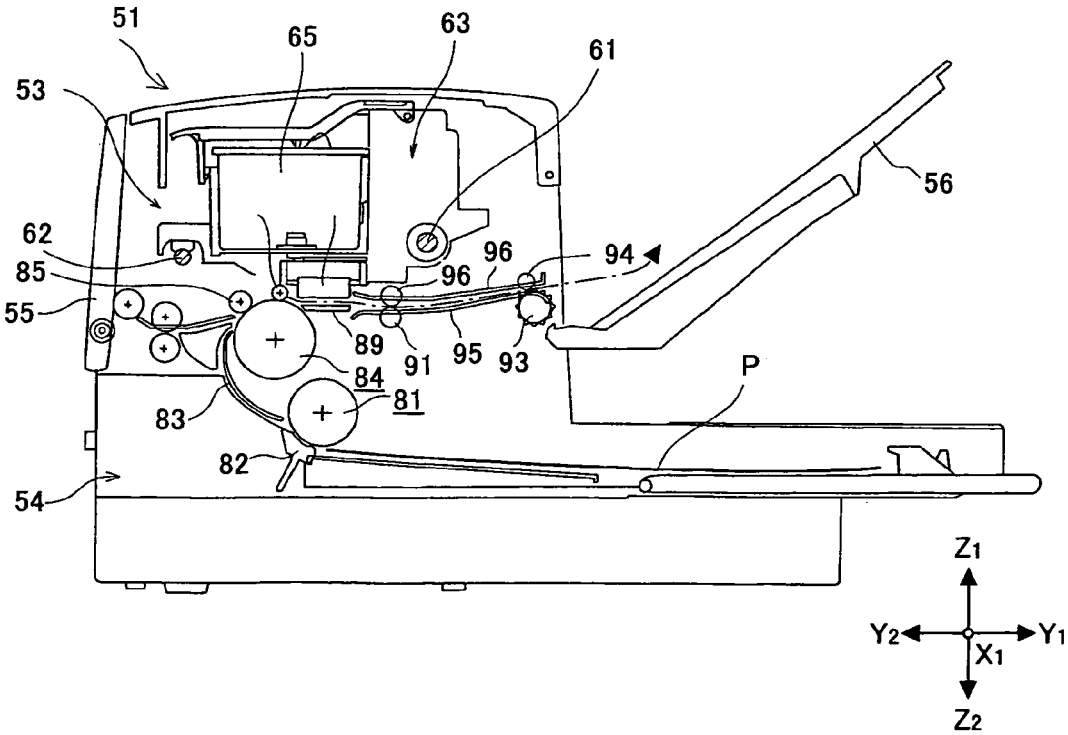
FIG. 24 is a side view of the mechanical part of an ink-jet recording apparatus according to a tenth embodiment of the present invention.
Figure 25:
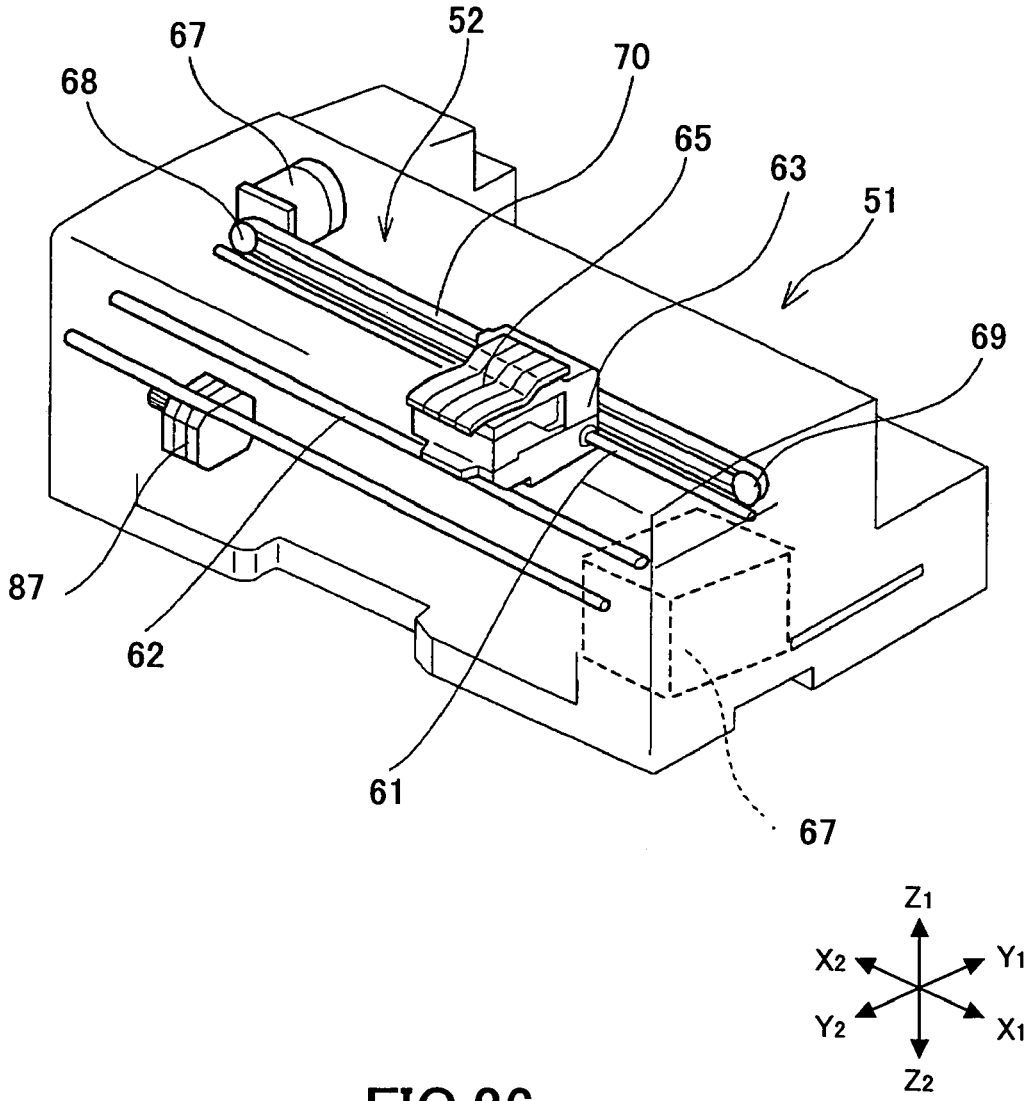
FIG. 25 is a perspective view of the ink-jet recording apparatus of FIG. 24 according to the tenth embodiment of the present invention.

Next, a description will be given, with reference to FIGS. 24 and 25, of an ink-jet recording apparatus according to a tenth embodiment of the present invention. The ink-jet recording apparatus of the tenth embodiment employs a liquid droplet ejecting head (an ink-jet head) according to any of the above-described first through eighth embodiments of the present invention. FIG. 24 is a side view of the mechanical part of the ink-jet recording apparatus, and FIG. 25 is a perspective view of the ink-jet recording apparatus.

The ink-jet recording apparatus includes a main body 51 including a print mechanism part 53. The print mechanism part 53 includes: a carriage,63 that is movable along the main scanning direction or the X-axis in FIG. 25; a plurality of recording heads 64 that are ink-jet heads (liquid droplet heads) according to the present invention, the recording heads 64 being mounted on the carriage 63; and ink cartridges 65 supplying ink to the recording heads 64. A paper feed cassette (or a paper feed tray) 54 that can hold a multitude of paper sheets P can be attached to the lower part of the main body 51 from the $Y_2$ (front) side so as to be freely detachable therefrom. A manual feed tray 55 for manually feeding the paper sheets P can be turned toward the $Y_2$ direction to be open. A paper sheet P fed from the paper feed cassette 54 or the manual feed tray 55 is conveyed to the print mechanism part 53, which records a necessary image on the paper sheet P. Thereafter, the paper sheet P is ejected onto a paper ejection tray 56 attached to the $Y_1$ (rear) side of the main body 51.

The print mechanism part 53 holds the carriage 63 on a primary guide rod 61 and a secondary guide rod 62 that are guide members so that the carriage 63 freely slides along the main scanning direction. The primary and secondary guide rods 61 and 62 are provided so as to extend between side plates (not shown in the drawings) provided on the $X_1$ and $X_2$ sides in the ink-jet recording apparatus. The recording heads 64 that eject color ink droplets of yellow (Y), cyan (C), magenta (M), and black (Bk), respectively, are arranged in the carriage 63 so that the ink ejecting holes (nozzles) of each recording head 64 are arranged in the direction to cross the main scanning direction so as to eject ink droplets in the downward ($Z_2$) direction. The ink cartridges 65 for supplying the recording heads 64 with the respective color inks are replaceably attached to the carriage 63. The ink-jet recording apparatus may employ an ink cartridge integrating a head and an ink tank according to the ninth embodiment of the present invention.

Each ink cartridge 65 includes an atmosphere hole communicating with the atmosphere in its upper part, a supply hole for supplying ink to the corresponding recording head 64 in its lower part, and a porous body filled with ink. The ink supplied to the recording head 64 is maintained at a slightly negative pressure by the capillary force of the porous body. The recording heads 64 of the respective colors employed in this embodiment may be replaced by a single recording head including nozzles for ejecting ink droplets of the respective colors.

The rear part of the carriage 63 is penetrated by the main guide rod 61 and the front part of the carriage 63 is placed on the secondary guide rod 62 so that the carriage 63 slides freely along the main scanning direction, guided by the primary and secondary guide rods 61 and 62. Here, "front" refers to the $Y_2$ side or the upstream side in the paper conveying direction in which the paper sheets P are conveyed, and "rear" refers to the $Y_1$ side or the downstream side in the paper conveying direction. In order to move the carriage 63 in the main scanning direction, a timing belt 70 runs between a drive pulley 68 rotated by a main scanning motor 67 and a driven pulley 69. The timing belt 70 is fixed to the carriage 63 so that the carriage 63 moves to and fro along the main scanning direction by the forward and reverse rotations of the main scanning motor 67.

In order to convey each of the paper sheets P set in the paper feed cassette 54 to a position below the recording heads 64, the ink-jet recording apparatus includes: a paper feed roller 81 and a friction pad 82 separately feeding the paper sheets P from the paper feed cassette 54; a guide member 83 guiding each fed paper sheet P; a conveying roller 84 conveying the fed paper sheet P so that the fed paper sheet P is turned upside down; a conveying roller 85 pressed against the surface of the conveying roller 84; and an edge roller 86 defining an angle at which the paper sheet P is fed out from the conveying roller 84. The conveying roller 84 is rotated by a sub scanning motor via a gear train.

Further, the ink-jet recording apparatus includes a print receiving member 89 that is a paper guide member guiding the paper sheet P fed from the conveying roller 84 below the recording heads 64 within the range of movement in the main scanning direction of the carriage 63. On the downstream side of the print receiving member 89 in the paper conveying direction, the ink-jet recording apparatus further includes: a conveying roller 91 and a spur 92 rotated so as to feed the paper sheet P toward the paper ejection direction in which the paper sheet P is ejected; a paper ejecting roller 93 and a spur 94 ejecting the paper sheet P onto the paper ejection tray 56; and guide members 95 and 96 forming a paper ejection path through which the paper sheet P is ejected.

At the time of recording, the recording heads 64 are driven in accordance with an image signal while the carriage 63 is being moved. Thereby, ink is ejected onto the paper sheet P at a standstill so that recording is performed for one line. After moving the paper sheet P a predetermined distance, recording is performed for the next line. When a recording end signal or a signal indicating that the trailing edge of the paper sheet P reaches the recording region is received, the recording operation is terminated and the paper sheet P is ejected. In this case, in each recording head 64, ink droplet ejection is more controllable and variation in the characteristics is suppressed. Therefore, the ink-jet recording apparatus of this embodiment can perform stable and high-quality image recording.

A recovery unit 67 for making a recovery from ejection failure in the recording heads 64 is provided on the $X_2$ side outside the recording region in the ink-jet recording apparatus. The recovery unit 97 includes a capping part, a suction part, and a cleaning part. The carriage 63, while waiting for printing, stays next to the recovery unit 97, having the recording heads 64 capped by the capping part so as to keep the ink ejecting holes in a moist state, thereby preventing ejection failure due to the drying of ink. Further, the recording heads 64, while performing recording, eject ink that is irrelevant to the recording so as to keep the ink viscosity of the ink ejecting holes constant, thereby maintaining stable ejection characteristics.

In the case of the occurrence of ejection failure, the ink ejecting holes of the recording heads 64 are hermetically sealed by the capping part of the recovery unit. 67. Then, air bubbles as well as ink are extracted by suction from the ink ejecting holes through a tube by the suction part, and ink and dust adhering to the ink ejecting surface of each recording head 64 are removed by the cleaning part. Thereby, a recovery is made from the ejection failure. The extracted ink is ejected to a waste ink reservoir (not shown in the drawing) provided in the lower part of the main body 51 so as to be absorbed into and retained in an ink absorbing body inside the waste ink reservoir.

Thus, the ink-jet recording apparatus of this embodiment employs the recording (ink-jet) heads 64 according to the present invent-ion so as to acquire stable ejection characteristics and improve image quality.

In this embodiment, the present invention is applied to the ink-jet head. However, the present invention is also applicable to a liquid droplet ejecting head ejecting droplets of liquid other than ink, such as a liquid resist for patterning or a DNA sample. Further, the present invention is also applicable to micro devices including an electrostatic actuator, such as a micropump, an optical device such as a micro-optical modulator, a microswitch (micro-relay), the actuator of a multi-optical lens (an optical switch), a micro-flowmeter, and a pressure sensor.

Eleventh Embodiment

Any of the electrostatic actuators of the liquid droplet ejecting heads (ink-jet heads) according to the above-described first through eighth embodiments is applicable to a micropump.

Figure 26:
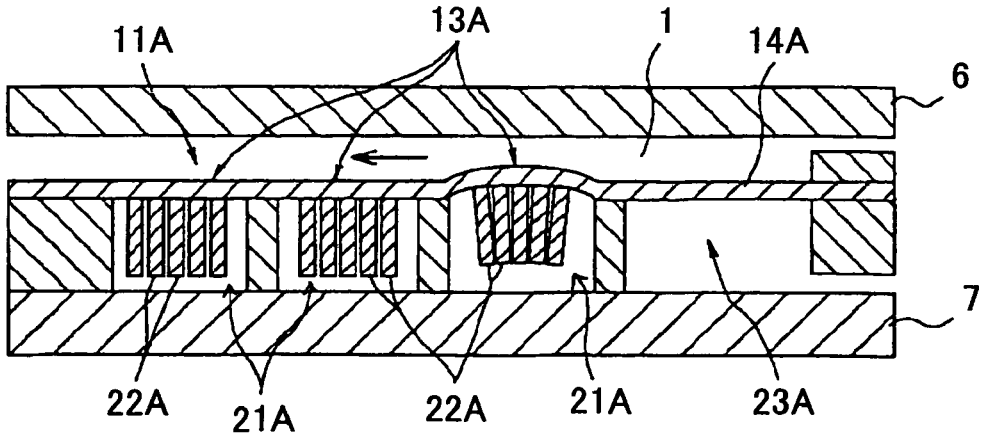
FIG. 26 is a sectional view of a micropump according to an eleventh embodiment of the present invention.

FIG. 26 is a sectional view of a micropump having a plurality of actuators to which the configuration of the actuators of any of the liquid droplet ejecting heads of the first through eighth embodiments is applied.

The actuators of the micropump according to the eleventh embodiment of the present invention form a plurality of diaphragms 13A provided between upper and lower substrates 6 and 7, a channel 11A for causing fluid to flow formed on the diaphragms 13A, a plurality of vibration chambers 21A provided along the channel 11A, and a pressure correcting chamber 23A provided next to one of the vibration chamber 21A in an end position. A deformable plate 14A configured to deform more easily than each diaphragm 13A is provided between the pressure correcting chamber 23A and the channel 11A. The vibration chambers 21A of all of the actuators communicate with the pressure correcting chamber 23A.

A plurality of electrodes 22A are provided to the diaphragm 13A of each actuator of the micropump. Each adjacent two of the electrodes 22A are supplied with respective potentials different from each other, so that the diaphragms 13A are caused to deflect. The deformable plate 14A, which forms a wall of the pressure correcting chamber 23A provided so as to communicate with each vibration chamber 21A, has its conditions including a plate thickness set so as to have a deformation greater than the total deformation of the diaphragms 13A. The micropump may have a plurality of pressure correcting chambers 23A.

The diaphragms 13A each having the electrodes 22A are arranged side by side along the flowing direction of the fluid so that the fluid flows in the channel 11A. The diaphragms 13A are successively driven from the one on the right side of FIG. 26 (the upstream side in the flowing direction of the fluid) by applying voltages to the electrodes 22A. Thereby, the fluid in the channel 11A is caused to flow in the direction indicated by the arrow in FIG. 26, so that the fluid can be transported. The diaphragms 13A employed in this embodiment may be replaced by a single diaphragm 13A. Further, a valve may be provided at an appropriate position in the channel 11A in order to increase the efficiency of the transportation of the fluid.

The micropump according to the eleventh embodiment thus includes the pressure correcting chamber 23A communicating with each vibration chamber 21A and the deformable plate 14A that deforms more easily than each diaphragm 13A. Therefore, when a difference is generated between the pressures inside and outside the vibration chambers 21A, the deformable plate 14A provided to the pressure correcting chamber 23A immediately deflects to eliminate the pressure difference before the diaphragms 13A deflect and deform due to the pressure difference to cause the malfunction of the micropump. Therefore, the micropump can maintain its function as a pump.

According to the present invention, an electrostatic actuator and a liquid droplet ejecting head having stable operation (ejection) characteristics to be employable in a wide range of environmental pressures can be manufactured at low cost by providing a head chip with a downsized pressure control part by processing part of an existing element without adding a special element such as a pressure detecting part. Further, an ink cartridge, an ink-jet recording apparatus, and a micropump using the same can be provided.

The present invention is not limited to the specifically disclosed embodiments, but variations and modifications may be made without departing from the scope of the present invention.

The present application is based on Japanese priority applications No. 2002-145300 filed on May 20, 2002 and No. 2002-259573 filed on Sep. 5, 2002, the entire contents of which are hereby incorporated by reference.

The invention claimed is:

1. A liquid droplet ejecting head ejecting liquid droplets by pressure waves caused by electrostatic forces, the liquid droplet ejecting head including: one or more nozzle holes ejecting the liquid droplets; one or more pressure liquid chambers communicating with the nozzle holes and containing liquid to be ejected; a common liquid chamber communicating with the pressure liquid chambers one or more diaphragms each forming a wall face of the corresponding pressure liquid chamber; one or more vibration chambers containing air gaps provided in contact with the diaphragms on an opposite side from the pressure liquid chambers; and one or more electrodes provided to oppose the diaphragms through the air gaps, the liquid droplets being ejected from the nozzle holes by increasing pressure inside the pressure liquid chambers by deflecting the diaphragms by the electrostatic forces generated by voltages applied to the electrodes, the liquid droplet ejecting head comprising:

a deformable plate whose deformation is greater than a total deformation of the diaphragms, the deformable plate forming a wall face of the common liquid chamber; and a pressure correcting chamber provided across said deformable plate from the common liquid chamber so as to communicate with the vibration chambers.

2. The liquid droplet ejecting head as claimed in claim 1, wherein said deformable plate has a thickness less than that of each diaphragm.

3. The liquid droplet ejecting head as claimed in claim 1, wherein said deformable plate has an in-plane length greater than that of each diaphragm.

4. The liquid droplet ejecting head as claimed in claim 1, wherein a change in a total volume $V_0$ of an actuator chamber is greater than or equal to $0.15 \times V_0$ if a pressure of 53 hPa is applied evenly to said deformable plate, the change in the total volume $V_0$ being caused by the deformation of said deformable plate.

5. The liquid droplet ejecting head as claimed in claim 1, wherein said pressure correcting chamber comprises a plurality of independent chambers corresponding to the vibration chambers.

6. An ink cartridge comprising:

a liquid droplet ejecting head ejecting ink droplets by pressure waves caused by electrostatic forces; and an ink tank supplying ink to said liquid droplet head, the ink tank being integrated with said liquid droplet ejecting head, wherein the liquid droplet ejecting head includes: one or more nozzle holes ejecting the ink droplets; one or more pressure liquid chambers communicating with the nozzle holes and containing the ink to be ejected; a common liquid chamber communicating with the pressure liquid chambers; one or more diaphragms each forming a wall face of the corresponding pressure liquid chamber; one or more vibration chambers containing air gaps provided in contact with the diaphragms on an opposite side from the pressure liquid chambers; and one or more electrodes provided to oppose the diaphragms through the air gaps, the ink droplets being ejected from the nozzle holes by increasing pressure inside the pressure liquid chambers by deflecting the diaphragms by the electrostatic forces generated by voltages applied to the electrodes, the liquid droplet ejecting head comprising:

a deformable plate whose deformation is greater than a total deformation of the diaphragms, the deformable plate forming a wall face of the common liquid chamber; and a pressure correcting chamber provided across said deformable plate from the common liquid chamber so as to communicate with the vibration chambers.

7. An ink-jet recording apparatus comprising:

an ink-jet head ejecting ink droplets by pressure waves caused by electrostatic forces, the ink-jet head including: one or more nozzle holes ejecting the ink droplets; one or more pressure liquid chambers communicating with the nozzle holes and containing ink to be ejected; a common liquid chamber communicating with the pressure liquid chambers; one or more diaphragms each forming a wall face of the corresponding pressure liquid chamber; one or more vibration chambers containing air gaps provided in contact with the diaphragms on an opposite side from the pressure liquid chambers; and one or more electrodes provided to oppose the diaphragms through the air gaps, the ink droplets being ejected from the nozzle holes by increasing pressure inside the pressure liquid chambers by deflecting the diaphragms by the electrostatic forces generated by voltages applied to the electrodes, the ink-jet head comprising:

a deformable plate whose deformation is greater than a total deformation of the diaphragms, the deformable plate forming a wall face of the common liquid chamber; and a pressure correcting chamber provided across said deformable plate from the common liquid chamber so as to communicate with the vibration chambers.

8. A micropump transporting liquid by deformation of one or more diaphragms, the micropump including: a channel in which the liquid is transported; the diaphragms forming a wall face of the channel; one or more vibration chambers air gaps provided in contact with the diaphragms on an opposite side from the channel; and a plurality of electrodes provided to each of the diaphragms, the liquid being transported by increasing pressure inside the channel by deflecting the diaphragms by electrostatic forces generated by voltages applied to the electrodes, the micropump comprising:

a deformable plate whose deformation is greater than a total deformation of the diaphragms, the deformable plate forming the wall face of the channel; and a pressure correcting chamber provided across said deformable plate from the channel so as to communicate with the vibration chambers.

9. An electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a part that reduces an area of contact formed when the deformable part comes into contact with a second side of the pressure correcting chamber, the second side opposing the deformable part.

10. The electrostatic actuator as claimed in claim 9, wherein at least one projection is formed on a side of the deformable part which side opposes the second side of the pressure correcting chamber.

11. The electrostatic actuator as claimed in claim 10, wherein the projection is formed of a material selected from a group of silicon oxide and nitride oxide.

12. The electrostatic actuator as claimed in claim 9, wherein at least one projection is formed on the second side of the pressure correcting chamber.

13. The electrostatic actuator as claimed in claim 12, wherein the projection is formed of a material selected from a group of silicon oxide and nitride oxide.

14. The electrostatic actuator as claimed in claim 9, wherein surface roughening is performed on the second side of the pressure correcting chamber so that surface roughness thereof is increased.

15. The electrostatic actuator of claim 9, wherein the deformable part has a lower rigidity than the diaphragm.

16. The electrostatic actuator of claim 9, wherein the deformable part is distinct from the diaphragm.

17. The electrostatic actuator of claim 9, wherein the pressure correcting chamber is distinct from the vibration chamber.

18. The electrostatic actuator of claim 9, wherein when a relative pressure difference as between the vibration chamber and an environment external to the electrostatic actuator changes, an equilibrium position of the deformable part changes while an equilibrium position of the diaphragm remains substantially unchanged.

19. An electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a sticking preventing part formed on a second side of the pressure correcting chamber so as to prevent the deformable part from sticking to the second side when the deformable part comes into contact therewith, the second side opposing the deformable part.

20. The electrostatic actuator as claimed in claim 19, wherein the sticking preventing part is a hydrophobic film.

21. The electrostatic actuator as claimed in claim 19, wherein the sticking preventing part is a conductive layer.

22. A liquid droplet ejecting head comprising:

a nozzle ejecting a liquid droplet;

a pressure liquid chamber containing liquid to be ejected, the pressure liquid chamber communicating with said nozzle; and an electrostatic actuator pressurizing the liquid in said pressure liquid chamber, the electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a part that reduces an area of contact formed when the deformable part comes into contact with a second side of the pressure correcting chamber, the second side opposing the deformable part.

23. A liquid droplet ejecting head comprising:

a nozzle ejecting a liquid droplet;

a pressure liquid chamber containing liquid to be ejected, the pressure liquid chamber communicating with said nozzle; and an electrostatic actuator pressurizing the liquid in said pressure liquid chamber, the electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a sticking preventing part formed on a second side of the pressure correcting chamber so as to prevent the deformable part from sticking to the second side when the deformable part comes into contact therewith, the second side opposing the deformable part.

24. An ink-jet recording apparatus comprising an ink-jet head ejecting an ink droplet, the ink-jet head comprising:

a nozzle ejecting the ink droplet;

a pressure liquid chamber containing ink to be ejected, the pressure liquid chamber communicating with said nozzle; and an electrostatic actuator pressurizing the ink in said pressure liquid chamber, the electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a part that reduces an area of contact formed when the deformable part comes into contact with a second side of the pressure correcting chamber, the second side opposing the deformable part.

25. An ink-jet recording apparatus comprising an ink-jet head ejecting an ink droplet, the ink-jet head comprising:

a nozzle ejecting the ink droplet;

a pressure liquid chamber containing ink to be ejected, the pressure liquid chamber communicating with said nozzle; and an electrostatic actuator pressurizing the ink in said pressure liquid chamber, the electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a sticking preventing part formed on a second side of the pressure correcting chamber so as to prevent the deformable part from sticking to the second side when the deformable part comes into contact therewith, the second side opposing the deformable part.

26. A liquid supply cartridge integrating a liquid droplet ejecting head and a liquid supply tank supplying liquid thereto, wherein the liquid droplet ejecting head comprises:

a nozzle ejecting a liquid droplet;

a pressure liquid chamber containing the liquid to be ejected, the pressure liquid chamber communicating with said nozzle; and an electrostatic actuator pressurizing the liquid in said pressure liquid chamber, the electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a part that reduces an area of contact formed when the deformable part comes into contact with a second side of the pressure correcting chamber, the second side opposing the deformable part.

27. A liquid supply cartridge integrating a liquid droplet ejecting head and a liquid supply tank supplying liquid thereto, wherein the liquid droplet ejecting head comprises:

a nozzle ejecting a liquid droplet;

a pressure liquid chamber containing the liquid to be ejected, the pressure liquid chamber communicating with said nozzle; and an electrostatic actuator pressurizing the liquid in said pressure liquid chamber, the electrostatic actuator comprising:

a vibration chamber having at least one side thereof formed by a diaphragm deformable by an electrostatic force;

an electrode provided opposite the diaphragm; and a pressure correcting chamber communicating with the vibration chamber, the pressure correcting chamber having at least a first side thereof formed by a deformable part that is displaceable in accordance with an external pressure, wherein the electrostatic actuator further includes:

a sticking preventing part formed on a second side of the pressure correcting chamber so as to prevent the deformable part from sticking to the second side when the deformable part comes into contact therewith, the second side opposing the deformable part.

* * * * *